US011525321B2

(12) United States Patent
Matheus Valero et al.

(10) Patent No.: US 11,525,321 B2
(45) Date of Patent: Dec. 13, 2022

(54) CONTROLLING RELEASE OF TORSIONAL ENERGY FROM A DRILL STRING

(71) Applicant: Schlumberger Technology Corporation, Sugar Land, TX (US)

(72) Inventors: Justo Elias Matheus Valero, Kristiansand (NO); Jan Alvaer, Kristiansand (NO); Juan-Carlos Yepez, Katy, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 37 days.

(21) Appl. No.: 17/078,234

(22) Filed: Oct. 23, 2020

(65) Prior Publication Data

US 2022/0127923 A1 Apr. 28, 2022

(51) Int. Cl.

| | |
|---|---|
| ***E21B 31/00*** | (2006.01) |
| ***E21B 44/06*** | (2006.01) |
| ***E21B 3/02*** | (2006.01) |
| ***E21B 21/08*** | (2006.01) |

(Continued)

(52) U.S. Cl.

CPC ..... *E21B 31/035* (2020.05); *E21B 3/022* (2020.05); *E21B 19/008* (2013.01); *E21B 21/08* (2013.01); *E21B 44/04* (2013.01); *E21B 44/06* (2013.01)

(58) Field of Classification Search

CPC ..... E21B 31/035; E21B 31/03; E21B 3/00; E21B 3/02; E21B 3/022; E21B 21/08; E21B 44/04; E21B 44/06

See application file for complete search history.

(56) References Cited

U.S. PATENT DOCUMENTS 6,401,838 B1 6/2002 Rezmer-Cooper
6,997,271 B2 * 2/2006 Nichols ..... E21B 17/07 175/325.2

(Continued)

FOREIGN PATENT DOCUMENTS

GB 2576802 A * 3/2020 ..... E21B 3/02
WO WO-2015026311 A1 * 2/2015 ..... E21B 44/00

(Continued)

OTHER PUBLICATIONS

International Search Report and Written Opinion issued in International Patent Application No. PCT/US2021/071987 dated Feb. 9, 2022; 11 pages.

*Primary Examiner* — Jennifer H Gay
(74) *Attorney, Agent, or Firm* — Kimberly D. Ballew

(57) ABSTRACT

Apparatus and methods for controlling release of torsional energy from a drill string having a lower portion that is stuck against a subterranean formation and a top end rotated by a top drive. The method may include decreasing a rotational speed set-point of the top drive, decreasing a torque set-point of the top drive, and/or decreasing flow rate of drilling mud being pumped downhole via the drill string, thereby decreasing torque output by a mud motor rotating a drill bit. The method may further include lifting the drill string to free the drill string. Decreasing the torque set-point of the top drive may comprise decreasing the torque set-point of the top drive to a minimum torque level that the top drive can output. Decreasing the rotational speed set-point of the top drive may comprise decreasing the rotational speed set-point of the top drive to zero.

20 Claims, 11 Drawing Sheets

(51) Int. Cl.
*E21B 44/04* (2006.01)
*E21B 19/00* (2006.01)

(56) References Cited

U.S. PATENT DOCUMENTS 7,243,735 B2 * 7/2007 Koederitz ..... E21B 45/00 175/40
7,857,075 B2 * 12/2010 Jeffryes ..... E21B 44/00 175/48
8,387,720 B1 * 3/2013 Keast ..... E21B 3/02 175/26
9,249,655 B1 * 2/2016 Keast ..... E21B 44/02
10,233,740 B2 * 3/2019 Patterson ..... G05B 19/404
10,895,142 B2 * 1/2021 Jeffryes ..... E21B 3/035
2004/0238219 A1 * 12/2004 Nichols ..... E21B 17/07 175/320
2005/0071120 A1 * 3/2005 Hutchinson ..... E21B 44/00 702/150
2011/0280104 A1 * 11/2011 McClung, III ..... E21B 3/02 175/170
2013/0313022 A1 * 11/2013 Kirkhope ..... E21B 23/00 175/107
2015/0134257 A1 5/2015 Erge et al.
2015/0240615 A1 8/2015 Dykstra et al.
2018/0073344 A1 * 3/2018 Patterson ..... G05B 19/404
2018/0274352 A1 * 9/2018 Orban ..... E21B 44/04
2020/0199994 A1 * 6/2020 Jeffryes ..... E21B 44/04
2020/0362687 A1 * 11/2020 Hopwood ..... E21B 4/02
2021/0062636 A1 * 3/2021 Jeffryes ..... E21B 3/035
2021/0301642 A1 * 9/2021 Wicks ..... E21B 7/04

FOREIGN PATENT DOCUMENTS

WO WO-2019050824 A1 * 3/2019 ..... E21B 3/02
WO WO-2021188432 A1 * 9/2021

* cited by examiner

CONTROLLING RELEASE OF TORSIONAL ENERGY FROM A DRILL STRING

BACKGROUND OF THE DISCLOSURE

Many oil/gas drilling rigs utilize a top drive that moves vertically along a derrick while simultaneously providing torque that rotates a drill string so that a drill bit at the lower end of the drill string drills through subterranean formations. The drill bit may also be rotated by a mud motor connected along the drill string above the drill bit. Depending upon friction along the wellbore and formation changes, the drill bit and/or a bottom-hole assembly (BHA) to which the drill bit is coupled may get stuck against the subterranean formation. However, telemetry signals indicative of a stuck drill bit and/or BHA may take a relatively long time (e.g., several seconds to a minute or longer) to reach wellsite surface to be detected by an equipment controller and/or by rig personnel via a control workstation. Thus, before the stuck drill bit and/or BHA is detected, the mud motor and/or the top drive may continue to rotate and twist the drill string at opposing ends, resulting in accumulation of torsional energy (i.e., torsional elastic energy) in the drill string. After the stuck drill bit and/or BHA is detected, the drill string may be lifted by a hoisting system (e.g., a drawworks) to lift the drill bit and the BHA off bottom to release the stuck drill bit and/or BHA. Such lifting can cause a sudden and uncontrolled release of the accumulated torsional energy in the drill string, causing high rotational (i.e., torsional) acceleration and back spin of the BHA. Mechanical stress caused by the high rotational acceleration can damage and/or decalibrate various tools of the BHA. However, current operations and equipment do not satisfactorily permit smooth or soft release of the torsional energy accumulated in the drill string.

SUMMARY OF THE DISCLOSURE

This summary is provided to introduce a selection of concepts that are further described below in the detailed description. This summary is not intended to identify indispensable features of the claimed subject matter, nor is it intended for use as an aid in limiting the scope of the claimed subject matter.

The present disclosure introduces an apparatus including a rotation sensor, a torque sensor, and a processing device that includes a processor and a memory storing computer program code. The rotation sensor is for rotational speed measurements indicative of rotational speed of a top drive for rotating a drill string. The torque sensor is for torque measurements indicative of torque output by the top drive. The processing device monitors the rotational speed measurements and the torque measurements during drilling operations. The processing device also determines that a lower portion of the drill string has become stuck downhole when the rotational speed measurements indicate that the rotational speed of the top drive is decreasing and the torque measurements indicate that the torque output by the top drive has increased to a predetermined maximum torque level.

The present disclosure also introduces a method that includes controlling release of torsional energy from a drill string having a lower portion that is stuck against a subterranean formation and a top end rotated by a top drive. The torsional energy release is controlled by decreasing a rotational speed set-point of the top drive and decreasing a torque set-point of the top drive, and then lifting the drill string to free the drill string.

The present disclosure also introduces a method that includes monitoring rotational speed measurements indicative of rotational speed of a top drive rotating a drill string. The method also includes monitoring torque measurements indicative of torque output by the top drive to the drill string. The method also includes determining that a lower portion of the drill string has become stuck downhole when the rotational speed measurements indicate that the rotational speed of the top drive is decreasing and the torque measurements indicate that the torque output by the top drive has increased to a predetermined maximum torque level.

These and additional aspects of the present disclosure are set forth in the description that follows, and/or may be learned by a person having ordinary skill in the art by reading the material herein and/or practicing the principles described herein. At least some aspects of the present disclosure may be achieved via means recited in the attached claims.

BRIEF DESCRIPTION OF THE DRAWINGS

The present disclosure is understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
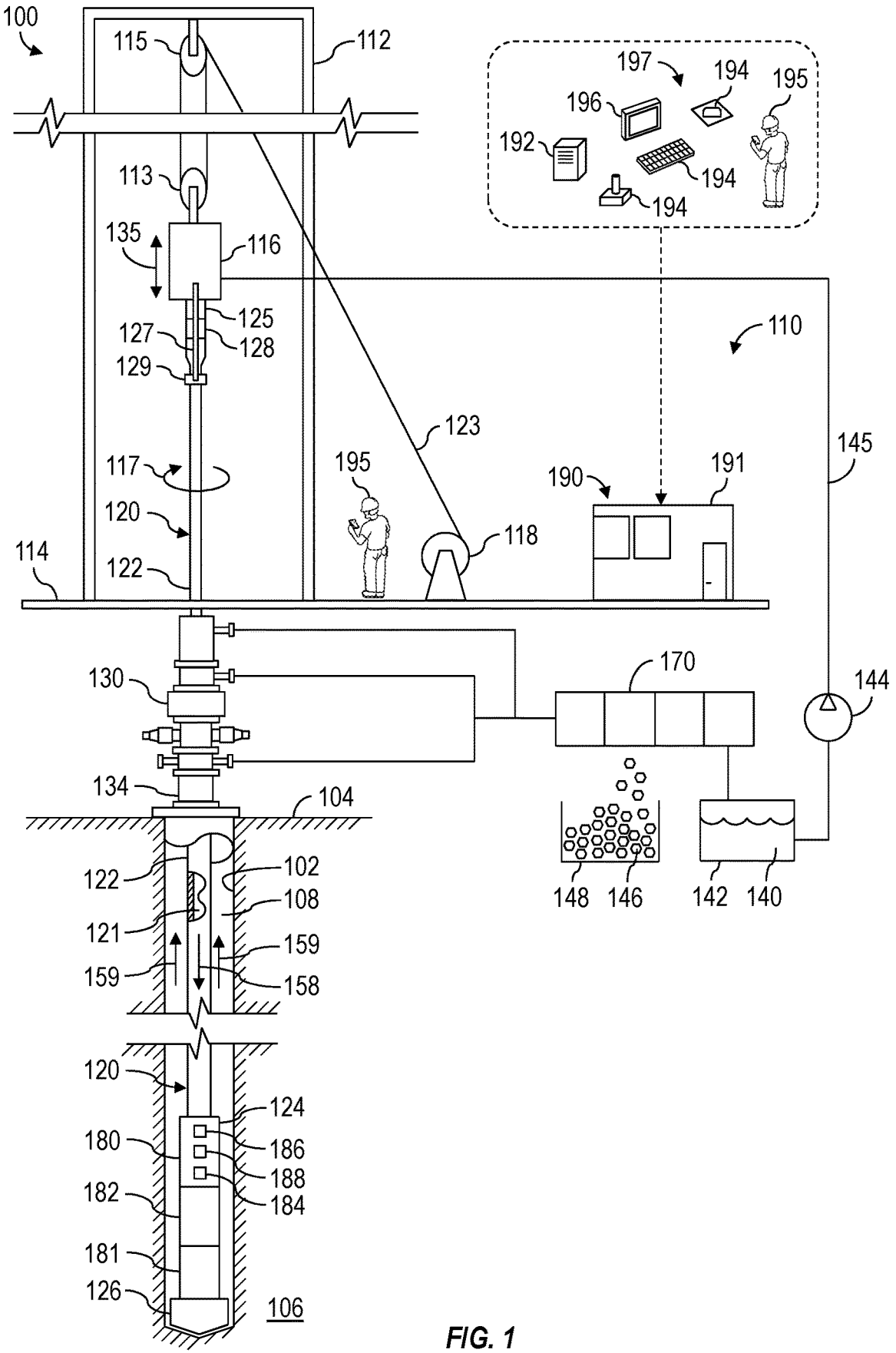
FIG. 1 is a schematic view of at least a portion of an example implementation of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity, and does not in itself dictate a relationship between the various embodiments and/or configurations discussed.

Systems and methods (e.g., processes, operations, etc.) according to one or more aspects of the present disclosure may be used or performed in association with a well construction system at a wellsite, such as for constructing a wellbore to obtain hydrocarbons (e.g., oil and/or gas) or other natural resources from a subterranean formation. A person having ordinary skill in the art will readily understand that one or more aspects of systems and methods disclosed herein may be utilized in other industries and/or in association with other systems.

FIG. 1 is a schematic view of at least a portion of an example implementation of a well construction system 100 according to one or more aspects of the present disclosure. The well construction system 100 represents an example environment in which one or more aspects of the present disclosure described below may be implemented. The well construction system 100 may be or comprise a drilling rig and associated equipment. Although the well construction system 100 is depicted as an onshore implementation, the aspects described below are also applicable to offshore implementations.

The well construction system 100 is depicted in relation to a wellbore 102 formed by rotary and/or directional drilling from a wellsite surface 104 and extending into a subterranean formation 106. The well construction system 100 comprises well construction equipment, such as surface equipment 110 located at the wellsite surface 104 and a drill string 120 suspended within the wellbore 102. The surface equipment 110 may include a mast, a derrick, and/or another support structure 112 disposed over a rig floor 114. The drill string 120 may be suspended within the wellbore 102 from the support structure 112. The support structure 112 and the rig floor 114 are collectively supported over the wellbore 102 by legs and/or other support structures (not shown). Certain pieces of surface equipment 110 may be manually operated (e.g., by hand, via a local control panel, etc.) by rig personnel 195 (e.g., a roughneck or another human rig operator) located at various portions (e.g., rig floor 114) of the well construction system 100.

The drill string 120 may comprise a bottom-hole assembly (BHA) 124 and means 122 for conveying the BHA 124 within the wellbore 102. The conveyance means 122 may comprise drill pipe, heavy-weight drill pipe (HWDP), wired drill pipe (WDP), tough logging condition (TLC) pipe, and/or other means for conveying the BHA 124 within the wellbore 102. A downhole end of the BHA 124 may include or be coupled to a drill bit 126. Rotation of the drill bit 126 and the weight of the drill string 120 collectively operate to form the wellbore 102. The drill bit 126 may be rotated via operation of a top drive 116 at the wellsite surface 104 and/or via operation of a downhole mud motor 182 operatively connected with the drill bit 126. The BHA 124 may also include one or more downhole tools 180, 181 connected above and/or below the mud motor 182.

One or more of the downhole tools 180, 181 may be or comprise a directional drilling tool, such as a bent sub operable to facilitate slide drilling or a rotary steerable system (RSS) operable to facilitate directional drilling while continuously rotating the drill string 120 from the surface (e.g., via the top drive 116). One or more of the downhole tools 180, 181 may be or comprise a measurement-while-drilling (MWD) or logging-while-drilling (LWD) tools comprising downhole sensors 184 operable for the acquisition of measurement data pertaining to the BHA 124, the wellbore 102, and/or the formation 106. The downhole sensors 184 may comprise an inclination sensor, a rotational position sensor, and/or a rotational speed sensor, which may include one or more accelerometers, magnetometers, gyroscopic sensors (e.g., micro-electro-mechanical system (MEMS) gyros), and/or other sensors for determining the orientation, position, and/or speed of one or more portions of the BHA 124 (e.g., the drill bit 126, the downhole tools 180, 181, and/or the mud motor 182) and/or other portions of the drill string 120 relative to the wellbore 102 and/or the wellsite surface 104. The downhole sensors 184 may comprise a depth correlation sensor utilized to determine and/or log position (i.e., depth) of one or more portions of the BHA 124 and/or other portions of the drill string 120 within the wellbore 102 and/or with respect to the wellsite surface 104. One or more of the downhole tools 180, 181 may be or comprise a power generating sub having a mud-powered turbine operable to generate electrical power to energize one or more of the electrical devices of the BHA 124.

One or more of the downhole tools 180, 181 may comprise a telemetry device 186 operable to communicate with the surface equipment 110, such as via mud-pulse telemetry, electromagnetic telemetry, and/or other telemetry means. One or more of the downhole tools 180, 181 and/or other portion(s) of the BHA 124 may also comprise a downhole controller 188 operable to receive, process, and/or store data received from the surface equipment 110, the downhole sensors 184, and/or other portions of the BHA 124. The controller 188 may also store executable computer programs (e.g., program code instructions), including for implementing one or more aspects of the operations described herein.

The support structure 112 may support the top drive 116, operable to connect with an upper end of the drill string 120, and to impart rotary motion 117 and vertical motion 135 to the drill string 120, including the drill bit 126. However, another driver, such as a kelly and a rotary table (neither shown), may be utilized in addition to or instead of the top drive 116 to impart the rotary motion 117 to the drill string 120.

The torque sensor 128 (e.g., a torque sub) may be mechanically connected or otherwise disposed between an upper end of the drill string 120 and a drive shaft 125 of the top drive 116. The torque sensor 128 may be operable to output torque sensor data (e.g., torque signals or measurements) indicative of torque applied by the top drive 116 to the drill string 120. The torque sensor 128 may also facilitate determination of rotational position, rotational distance, rotational speed, and rotational acceleration of the drive shaft 125.

The top drive 116 may be suspended from (supported by) the support structure 112 via a hoisting system operable to impart vertical motion 135 to the top drive 116 and the drill string 120 connected to the top drive 116. During drilling operations, the top drive 116, in conjunction with operation of the hoisting system, may advance the drill string 120 into the formation 106 to form the wellbore 102. The hoisting system may comprise a traveling block 113, a crown block 115, and a drawworks 118 storing a flexible line 123 (e.g., a cable, a wire rope, etc.). The crown block 115 may be connected to and supported by the support structure 112, and the traveling block 113 may be connected to and support the top drive 116. The drawworks 118 may be mounted to the rig floor 114. The crown block 115 and traveling block 113 comprise pulleys or sheaves around which the flexible line 123 is reeved to operatively connect the crown block 115, the traveling block 113, and the drawworks 118. The drawworks 118 may comprise a drum and an electric motor (not shown) operatively connected with and operable to rotate the drum. The drawworks 118 may selectively impart tension to the flexible line 123 to lift and lower the top drive 116, resulting in the vertical movement 135 of the top drive 116 and the drill string 120 (when connected with the top drive 116). The drawworks 118 may be operable to reel in the flexible line 123, causing the traveling block 113 and the top drive 116 to move upward. The drawworks 118 may be further operable to reel out the flexible line 123, causing the traveling block 113 and the top drive 116 to move downward.

The top drive 116 may comprise a grabber, a swivel (neither shown), elevator links 127 terminating with an elevator 129, and a drive shaft 125 operatively connected with a prime mover (e.g., an electric motor) (not shown) of the top drive 116, such as via a gear box or transmission (not shown). The drive shaft 125 may be selectively coupled with the upper end of the drill string 120 (perhaps indirectly via the torque sub 128) and the prime mover may be selectively operated to rotate the drive shaft 125 and the drill string 120 coupled with the drive shaft 125. The elevator links 127 and the elevator 129 of the top drive 116 may handle tubulars (e.g., joints and/or stands of drillpipe, drill collars, casing, etc.) that are not mechanically coupled to the drive shaft 125. For example, when the drill string 120 is being tripped into or out of the wellbore 102, the elevator 129 may grasp the tubulars of the drill string 120 such that the tubulars may be raised and/or lowered via the hoisting equipment mechanically coupled to the top drive 116. The top drive 116 may have a guide system (not shown), such as rollers that track up and down a guide rail on the support structure 112. The guide system may aid in keeping the top drive 116 aligned with the wellbore 102, and in preventing the top drive 116 from rotating during drilling by transferring reactive torque to the support structure 112.

The well construction system 100 may further include a drilling fluid circulation system or equipment operable to circulate fluids between the surface equipment 110 and the drill bit 126 during drilling and other operations. For example, the drilling fluid circulation system may be operable to inject a drilling fluid from the wellsite surface 104 into the wellbore 102 via an internal fluid passage 121 extending longitudinally through the drill string 120. The drilling fluid circulation system may comprise a pit, a tank, and/or other fluid container 142 holding the drilling fluid 140 (i.e., drilling mud), and one or more pumps 144 operable to move the drilling fluid 140 from the container 142 into the fluid passage 121 of the drill string 120 via a fluid conduit 145 (e.g., a stand pipe) extending from the pump 144 to the top drive 116 and an internal passage extending through the top drive 116 (not shown).

During drilling operations, the drilling fluid may continue to flow downhole through the internal passage 121 of the drill string 120, as indicated by directional arrow 158. The drilling fluid may exit the BHA 124 via ports in the mud motor 182 and/or drill bit 126 and then circulate uphole through an annular space 108 of the wellbore 102 defined between an exterior of the drill string 120 and the sidewall of the wellbore 102, such flow being indicated in FIG. 1 by directional arrows 159. In this manner, the drilling fluid lubricates the drill bit 126 and carries formation cuttings uphole to the wellsite surface 104. The drilling fluid flowing downhole through the internal passage 121 may selectively actuate the mud motor 182 to rotate the drill bit 126 instead of or in addition to the rotation of the drill string 120 via the top drive 116. Accordingly, rotation of the drill bit 126 caused by the top drive 116 and/or mud motor 182, in conjunction with the weight-on-bit (WOB), may advance the drill string 120 through the formation 106 to form the wellbore 102.

The well construction system 100 may further include fluid control equipment 130 for maintaining well pressure control and for controlling fluid being discharged from the wellbore 102. The fluid control equipment 130 may be mounted on top of a wellhead 134. The drilling fluid flowing uphole 159 toward the wellsite surface 104 may exit the annulus 108 via one or more components of the fluid control equipment 130, such as a bell nipple, a rotating control device (RCD), and/or a ported adapter (e.g., a spool, a cross adapter, a wing valve, etc.). The drilling fluid may then pass through drilling fluid reconditioning equipment 170 to be cleaned and reconditioned before returning to the fluid container 142. The drilling fluid reconditioning equipment 170 may also separate drill cuttings 146 from the drilling fluid into a cuttings container 148.

The surface equipment 110 of the well construction system 100 may also comprise a control center 190 from which various portions of the well construction system 100, such as a drill string rotation system (e.g., the top drive 116), a hoisting system (e.g., the drawworks 118 and the blocks 113, 115), a drilling fluid circulation system (e.g., the mud pump 144 and the fluid conduit 145), a drilling fluid cleaning and reconditioning system (e.g., the drilling fluid reconditioning equipment 170 and the containers 142, 148), the well control system (e.g., a BOP stack, a choke manifold, and/or other components of the fluid control equipment 130), and the BHA 124, among other examples, may be monitored and controlled. The control center 190 may be located on the rig floor 114 or another location of the well construction system 100, such as the wellsite surface 104. The control center 190 may comprise a facility 191 (e.g., a room, a cabin, a trailer, a truck or other service vehicle, etc.) containing a control workstation 197, which may be operated by rig personnel 195 (e.g., a driller or other human rig operator(s)) to monitor and control various wellsite equipment and/or portions of the well construction system 100. The control workstation 197 may comprise or be communicatively connected with a surface equipment controller 192 (e.g., a processing device, a computer, etc.), such as may be operable to receive, process, and output information to monitor operations of and provide control to one or more portions of the well construction system 100. For example, the controller 192 may be communicatively connected with the surface equipment 110 and downhole equipment 120 described herein, and may be operable to receive signals (e.g., sensor data, sensor measurements, etc.) from and transmit signals (e.g., control data, control signals, control commands, etc.) to the equipment to perform various operations described herein. The controller 192 may store executable program code, instructions, and/or operational parameters or set-points, including for implementing one or more aspects of methods and operations described herein. The controller 192 may be located within and/or outside of the facility 191.

The control workstation 197 may be operable for entering or otherwise communicating control commands to the controller 192 by the rig personnel 195, and for displaying or otherwise communicating information from the controller 192 to the rig personnel 195. The control workstation 197 may comprise one or more input devices 194 (e.g., one or more keyboards, mouse devices, joysticks, touchscreens, etc.) and one or more output devices 196 (e.g., one or more video monitors, touchscreens, printers, audio speakers, etc.). Communication between the controller 192, the input and output devices 194, 196, and components of the wellsite equipment may be via wired and/or wireless communication means. However, for clarity and ease of understanding, such communication means are not depicted, and a person having ordinary skill in the art will appreciate that such communication means are within the scope of the present disclosure.

Well construction systems within the scope of the present disclosure may include more or fewer components than as described above and depicted in FIG. 1. Additionally, various equipment and/or subsystems of the well construction system 100 shown in FIG. 1 may include more or fewer components than as described above and depicted in FIG. 1. For example, various engines, motors, hydraulics, actuators, valves, and/or other components not explicitly described herein may be included in the well construction system 100 and are within the scope of the present disclosure.

Figure 2:
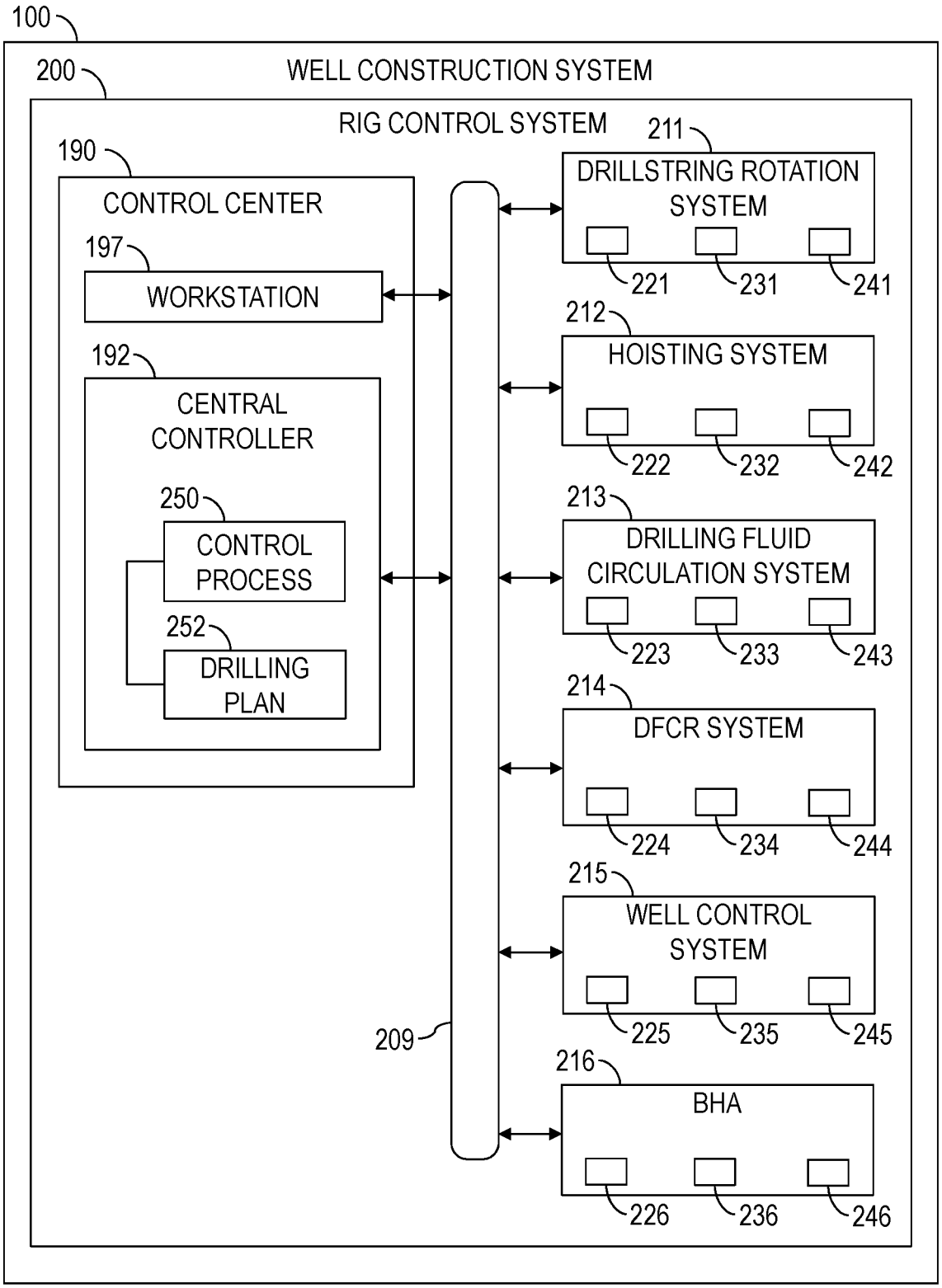
FIG. 2 is a schematic view of at least a portion of an example implementation of apparatus according to one or more aspects of the present disclosure.

The present disclosure further provides various implementations of systems and/or methods for controlling one or more portions of the well construction system 100. FIG. 2 is a schematic view of at least a portion of an example implementation of a drilling rig control system 200 (hereinafter "rig control system") for monitoring and controlling various equipment, portions, and subsystems of the well construction system 100 shown in FIG. 1. The rig control system 200 may comprise one or more features of the well construction system 100, including where indicated by the same reference numerals. Accordingly, the following description refers to FIGS. 1 and 2, collectively. However, the rig control system 200 depicted in FIG. 2, as well as other implementations of rig control systems also within the scope of the present disclosure, may also be applicable or readily adapted for utilization with other implementations of well construction systems also within the scope of the present disclosure.

The various pieces of well construction equipment described above and shown in FIGS. 1 and 2 may each comprise one or more actuators (e.g., combustion, hydraulic, and/or electrical), which when operated may cause the corresponding well construction equipment to perform intended actions (e.g., work, tasks, movements, operations, etc.). Each piece of well construction equipment may further carry or comprise one or more sensors disposed in association with a corresponding actuator or another portion of the piece of equipment. Each sensor may be communicatively connected with a corresponding equipment controller and operable to generate sensor data (e.g., electrical sensor signals or measurements) indicative of an operational (e.g., mechanical or physical) status of the corresponding actuator or component, thereby permitting the operational status of the actuator to be monitored by the equipment controller. The sensor data may be utilized by the equipment controller as feedback data, permitting operational control of the piece of well construction equipment and coordination with other well construction equipment. Such sensor data may be indicative of performance of each individual actuator and, collectively, of the entire piece of well construction equipment.

The rig control system 200 may be in real-time communication with one or more components, subsystems, systems, and/or other equipment of the well construction system 100 that are monitored and/or controlled by the rig control system 200. As described above, the equipment of the well construction system 100 may be grouped into several subsystems, each operable to perform a corresponding operation and/or a portion of the well construction operations described herein. For example, the subsystems may include a drill string rotation system 211 (e.g., the top drive 116), a hoisting system 212 (e.g., the drawworks 118 and the blocks 113, 115), a drilling fluid circulation system 213 (e.g., the mud pump 144 and the fluid conduit 145), a drilling fluid cleaning and reconditioning (DFCR) system 214 (e.g., the drilling fluid reconditioning equipment 170 and the containers 142, 148), a well control system 215 (e.g., a BOP stack, a choke manifold, and/or other components of the fluid control equipment 130), and the BHA 124 (designated in FIG. 2 by reference number 216), among other examples. The control workstation 197 may be utilized by rig personnel to monitor, configure, control, and/or otherwise operate one or more of the subsystems 211-216.

Each of the well construction subsystems 211-216 may further comprise various communication equipment (e.g., modems, network interface cards, etc.) and communication conductors (e.g., cables) communicatively connecting the equipment (e.g., sensors and actuators) of each subsystem 211-216 with the control workstation 197 and/or other equipment. Although the well construction equipment described above and shown in FIG. 1 is associated with certain wellsite subsystems 211-216, such associations are merely examples that are not intended to limit or prevent such well construction equipment from being associated with two or more of the wellsite subsystems 211-216 and/or different wellsite subsystems 211-216.

One or more of the subsystems 211-216 may include one or more local controllers 221-226, each operable to control various well construction equipment of the corresponding subsystem 211-216 and/or an individual piece of well construction equipment of the corresponding subsystem 211-216. Each well construction subsystem 211-216 includes various well construction equipment comprising corresponding actuators 241-246 for performing operations of the well construction system 100. One or more of the subsystems 211-216 may include various sensors 231-236 operable to generate or output sensor data (e.g., signals, information, measurements, etc.) indicative of operational status of the well construction equipment of the corresponding subsystem 211-216. Each local controller 221-226 may output control data (e.g., commands, signals, information, etc.) to one or more actuators 241-246 to perform corresponding actions of a piece of equipment of the corresponding subsystem 211-216. One or more of the local controllers 221-226 may receive sensor data generated by one or more corresponding sensors 231-236 indicative of operational status of an actuator or another portion of a piece of equipment of the corresponding subsystem 211-216. Although the local controllers 221-226, the sensors 231-236, and the actuators 241-246 are each shown as a single block, it is to be understood that each local controller 221-226, sensor 231-236, and actuator 241-246 may illustratively represent a plurality of local controllers, sensors, and actuators.

The sensors 231-236 may include sensors utilized for operation of the various subsystems 211-216 of the well construction system 100. For example, the sensors 231-236 may include cameras, position sensors, pressure sensors, temperature sensors, flow rate sensors, vibration sensors, current sensors, voltage sensors, resistance sensors, gesture detection sensors or devices, voice actuated or recognition devices or sensors, and/or other examples. The sensor data may include signals, information, and/or measurements indicative of equipment operational status (e.g., on or off, up or down, set or released, etc.), drilling parameters (e.g., depth, hook load, torque, etc.), auxiliary parameters (e.g., vibration data of a pump), flow rate, temperature, operational speed, position, and pressure, among other examples.

The acquired sensor data may include or be associated with a timestamp (e.g., date and/or time) indicative of when the sensor data was acquired. The sensor data may also or instead be aligned with a depth or other drilling parameter.

For example, the sensors 231 may comprise one or more rotation sensors operable to output or otherwise facilitate rotational position, rotational speed, and/or rotational acceleration measurements of the top drive 116 (e.g., the drive shaft 125) indicative of rotational position, rotational speed, and/or rotational acceleration of the upper end of the drill string 120 connected to the top drive 116. The sensors 231 may also comprise one or more torque sensors (e.g., the torque sub 128) operable to facilitate torque measurements indicative of torque output by the top drive 116 to the top of the drill string 120. The torque sensors may also or instead be or comprise a variable frequency drive (VFD) supplying electrical power to the top drive 116, whereby torque output by the top drive 116 to the drill string 120 may be measured or otherwise determined based on measurements of electrical current transmitted to the top drive 116 by the VFD. The sensors 232 may comprise one or more rotation sensors operable to output or otherwise facilitate rotational position, rotational speed, and/or rotational acceleration measurements of the drawworks 118 indicative of vertical position, vertical speed, and/or vertical acceleration of the traveling block 113 and the drill string 120 (including the BHA 124) connected to the travelling block 113 via the top drive 116. The sensors 233 may comprise one or more pressure sensors operable to facilitate pressure measurements indicative of pressure of the drilling fluid being pumped downhole by the mud pumps 144 via the internal fluid passage 121 of the drill string 120. The pressure sensors may be disposed at the outlets of the pumps 144 and/or along the fluid conduit 145.

The local controllers 221-226, the sensors 231-236, and the actuators 241-246 may be communicatively connected with a central controller 192. For example, the local controllers 221-226 may be in communication with the sensors 231-236 and actuators 241-246 of the corresponding subsystems 211-216 via local communication networks (e.g., field buses) (not shown) and the central controller 192 may be in communication with the subsystems 211-216 via a central communication network 209 (e.g., a data bus, a field bus, a wide-area-network (WAN), a local-area-network (LAN), etc.). The sensor data generated by the sensors 231-236 of the subsystems 211-216 may be made available for use by the central controller 192 and/or the local controllers 221-226. Similarly, control data output by the central controller 192 and/or the local controllers 221-226 may be automatically communicated to the various actuators 241-246 of the subsystems 211-216, perhaps pursuant to predetermined programming, such as to facilitate well construction operations and/or other operations described herein. Although the central controller 192 is shown as a single device (i.e., a discrete hardware component), it is to be understood that the central controller 192 may be or comprise a plurality of equipment controllers and/or other electronic devices collectively operable to perform operations (i.e., computational processes or methods) described herein.

The sensors 231-236 and actuators 241-246 may be monitored and/or controlled by corresponding local controllers 221-226 and/or the central controller 192. For example, the central controller 192 may be operable to receive sensor data from the sensors 231-236 of the subsystems 211-216 in real-time, and to output real-time control data directly to the actuators 241-246 of the subsystems 211-216 based on the received sensor data. However, certain operations of the actuators 241-246 of one or more of the subsystems 211-216 may be controlled by a corresponding local controller 221-226, which may control the actuators 241-246 based on sensor data received from the sensors 231-236 of the corresponding subsystem 211-216 and/or based on control data received from the central controller 192.

The rig control system 200 may be a tiered control system, wherein control of the subsystems 211-216 of the well construction system 100 may be provided via a first tier of the local controllers 221-226 and a second tier of the central controller 192. The central controller 192 may facilitate control of one or more of the subsystems 211-216 at the level of each individual subsystem 211-216. For example, in the hoisting system 212, sensor data may be fed into the local controller 242, which may respond to control the actuators 232. However, for control operations that involve more than one of the subsystems 211-216, the control may be coordinated through the central controller 192 operable to coordinate control of well construction equipment of two, three, four, or more (each) of the subsystems 211-216.

The downhole controller 188, the central controller 192, the local controllers 221-226, and/or other controllers or processing devices (individually or collectively referred to hereinafter as an "equipment controller") of the rig control system 200 may each or collectively be operable to receive and store machine-readable and executable program code instructions (e.g., computer program code, algorithms, programmed processes or operations, etc.) on a memory device (e.g., a memory chip) and then execute the program code instructions to run, operate, or perform a control process for monitoring and/or controlling the well construction equipment of the well construction system 100. The central controller 192 may run (i.e., execute) a control process 250 (e.g., a coordinated control process or anther computer process) and each local controller 221-226 may run a corresponding control process (e.g., a local control process or another computer processor) (not shown). Two or more of the local controllers 221-226 may run their local control processes to collectively coordinate operations between well construction equipment of two or more of the subsystems 211-216.

The control process 250 of the central controller 192 may operate as a mechanization manager of the rig control system 190, such as by coordinating operational sequences of the well construction equipment of the well construction system 100. The control process of each local controller 221-226 may facilitate a lower (e.g., basic) level of control within the rig control system 200 to operate a corresponding piece of well construction equipment or a plurality of pieces of well construction equipment of a corresponding subsystem 211-216. Such control process may facilitate, for example, starting, stopping, and setting or maintaining an operating speed of a piece of well construction equipment.

The control process 250 of the central controller 192 may output control data directly to the actuators 241-246 to control the well construction operations. The control process 250 may also or instead output control data to the control process of one or more local controllers 221-226, wherein each control process of the local controllers 221-226 may then output control data to the actuators 241-246 of the corresponding subsystem 211-216 to control a portion of the well construction operations performed by that subsystem 211-216. Thus, the control processes of equipment controllers (e.g., the central controller 192 and/or the local controllers 221-226) of the rig control system 200 individually and collectively perform monitoring and control operations described herein, including monitoring and controlling well construction operations. The program code instructions forming the basis for the control processes described herein may comprise rules (e.g., algorithms) based upon the laws of physics for drilling and other well construction operations.

Each control process being run by an equipment controller of the rig control system 200 may receive and process (i.e., analyze) sensor data from one or more of the sensors 231-236 according to the program code instructions, and generate control data (i.e., control signals or information) to operate or otherwise control one or more of the actuators 241-246 of the well construction equipment. Equipment controllers within the scope of the present disclosure can include, for example, programmable logic controllers (PLCs), industrial computers (IPCs), personal computers (PCs), soft PLCs, variable frequency drives (VFDs), and/or other controllers or processing devices operable to store and execute program code instructions, receive sensor data, and output control data to cause operation of the well construction equipment based on the program code instructions, sensor data, and/or control data.

A control workstation 197 may be communicatively connected with the central controller 192 and/or the local controllers 221-226 via the communication network 209, such as to receive sensor data from the sensors 231-236 and transmit control data to the central controller 192 and/or the local controllers 221-226 to control the actuators 241-246. Accordingly, the control workstation 197 may be utilized by rig personnel (e.g., a driller) to monitor and control the actuators 241-246 and other portions of the subsystems 211-216 via the central controller 192 and/or local controllers 221-226.

The central controller 192 may comprise a memory device operable to receive and store a well construction plan 252 (e.g., a drilling plan) for drilling and/or otherwise constructing a planned well. The well construction plan 252 may include well specifications, drill string specifications, operational parameters, schedules, and other information indicative of the planned well and the well construction equipment of the well construction system 100. For example, the well construction plan 252 may include properties of the subterranean formation through which the planned well is to be drilled, the path (e.g., direction, curvature, orientation, etc.) along which the planned well is to be drilled through the formation, the depth (e.g., true vertical depth (TVD) or measured depth (MD)) of the planned well, operational specifications (e.g., power output, weight, torque capabilities, speed capabilities, dimensions, size, etc.) of the well construction equipment (e.g., top drive 116, mud pumps 144, downhole mud motor 182, etc.) that is planned to be used to construct the planned well, and/or specifications (e.g., diameter, length, weight, etc.) of tubulars (e.g., drill pipe) that are planned to be used to construct the planned well. The well construction plan 252 may further include planned operational parameters of the well construction equipment during the well construction operations, such as weight on bit (WOB), top drive rotational speed (e.g., measured in revolutions per minute (RPM)), and rate of penetration (ROP) as a function of wellbore depth.

Figure 3:
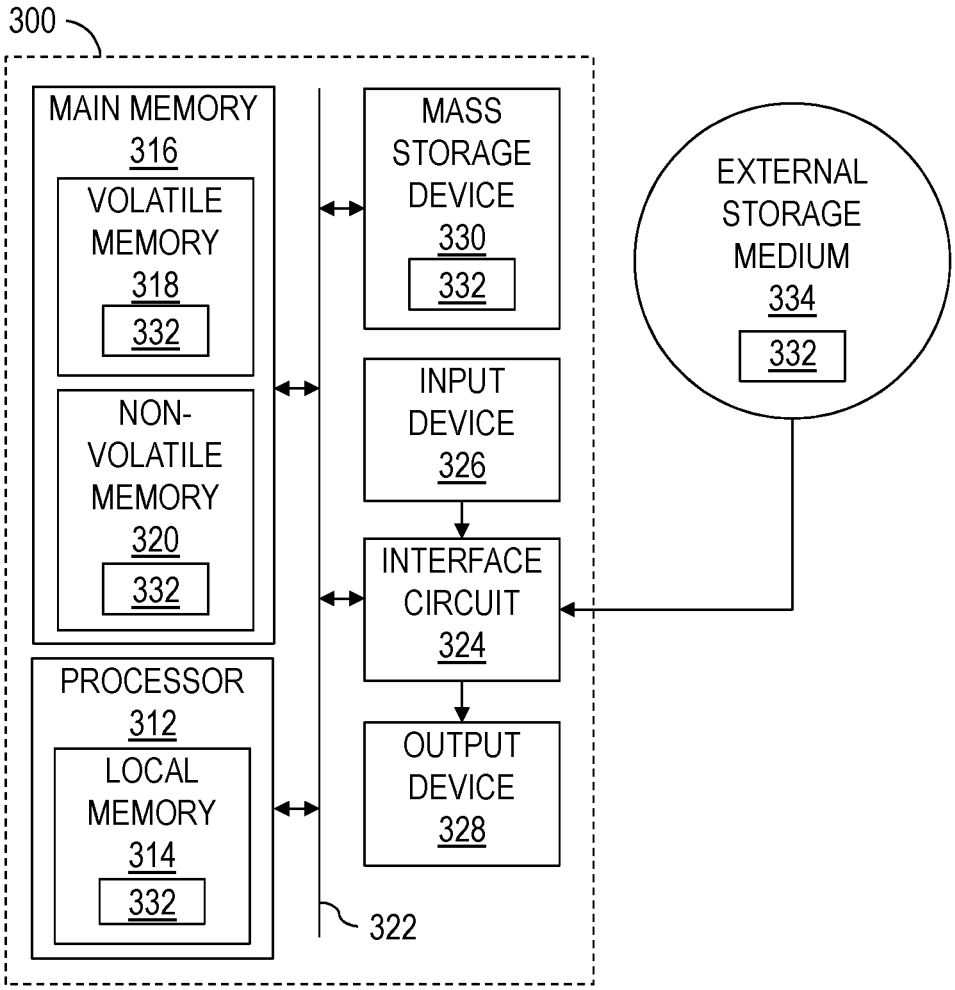
FIG. 3 is a schematic view of at least a portion of an example implementation of apparatus according to one or more aspects of the present disclosure.
Figure 4:
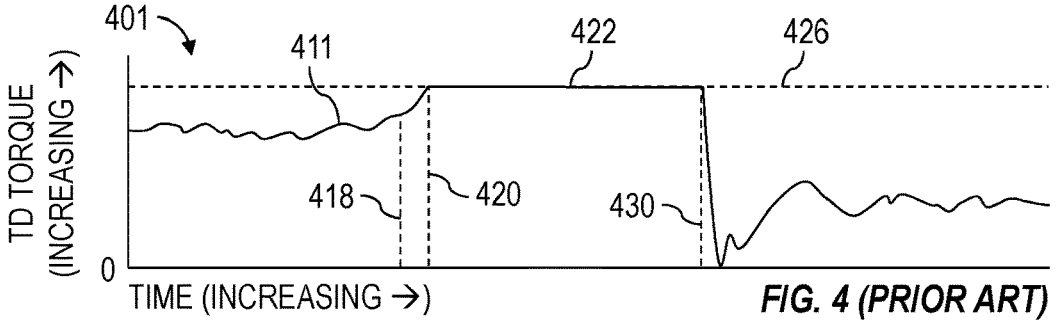
FIG. 4 (PRIOR ART)
FIGS. 4-8 are graphs related to one or more aspects of the present disclosure.
Figure 5:
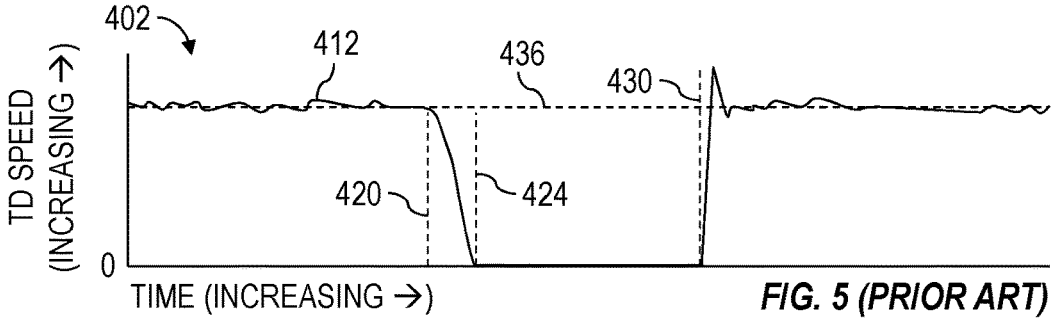
FIG. 5 (PRIOR ART)
Figure 6:
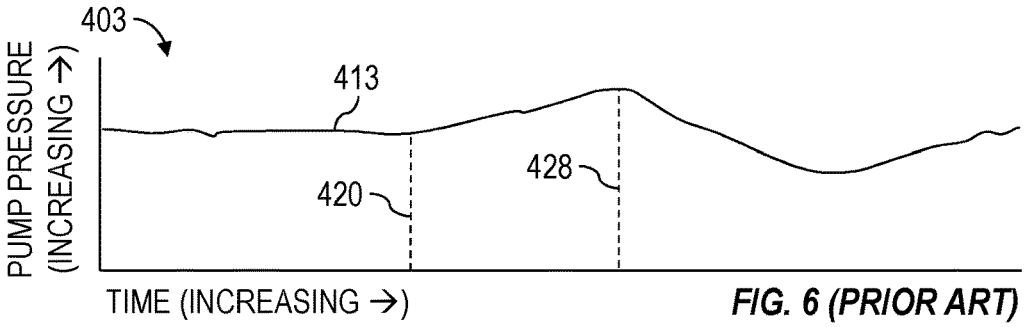
FIG. 6 (PRIOR ART)
Figure 7:
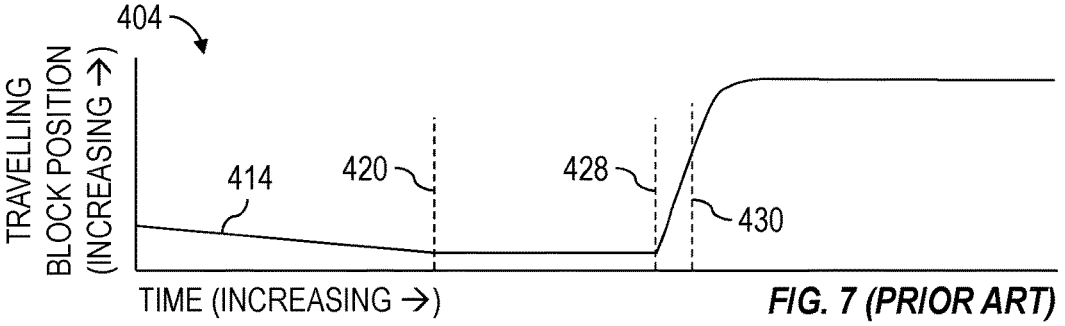
FIG. 7 (PRIOR ART)
Figure 8:
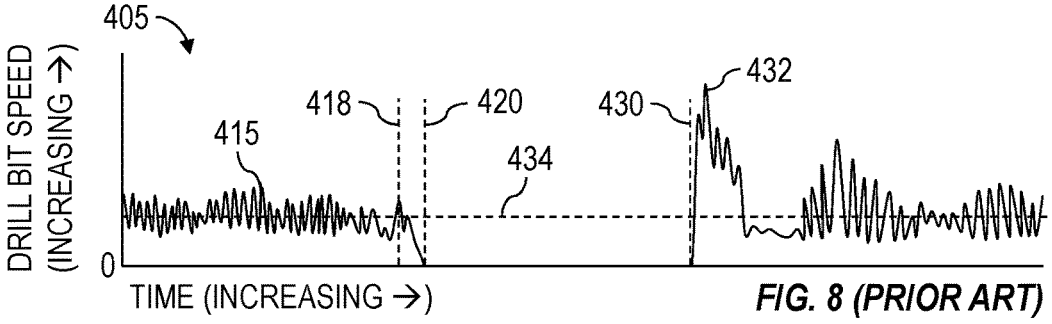
FIG. 8 (PRIOR ART)

FIG. 3 is a schematic view of at least a portion of an example implementation of a processing device 300 (or system) according to one or more aspects of the present disclosure. The processing device 300 may be or form at least a portion of one or more equipment controllers and/or other electronic devices shown in one or more of the FIGS. 1 and 2. Accordingly, the following description refers to FIGS. 1-3, collectively.

The processing device 300 may be or comprise, for example, one or more processors, controllers, special-purpose computing devices, PCs (e.g., desktop, laptop, and/or tablet computers), personal digital assistants, smartphones, IPCs, PLCs, servers, internet appliances, and/or other types of computing devices. One or more instances of the processing device 300 may be or form at least a portion of the rig control system 200. For example, one or more instances of the processing device 300 may be or form at least a portion of the downhole controller 188, the central controller 192, one or more of the local controllers 221-226, and/or the control workstation 197. Although it is possible that the entirety of the processing device 300 is implemented within one device, it is also contemplated that one or more components or functions of the processing device 300 may be implemented across multiple devices, some or an entirety of which may be at the wellsite and/or remote from the wellsite.

The processing device 300 may comprise a processor 312, such as a general-purpose programmable processor. The processor 312 may comprise a local memory 314 and may execute machine-readable and executable program code instructions 332 (i.e., computer program code) present in the local memory 314 and/or another memory device. The processor 312 may execute, among other things, the program code instructions 332 and/or other instructions and/or programs to implement the example methods and/or operations described herein. For example, the program code instructions 332, when executed by the processor 312 of the processing device 300, may cause the processor 312 to receive and process (e.g., compare) sensor data (e.g., sensor measurements) and output information indicative of accuracy the sensor data, and thus the corresponding sensors according to one or more aspects of the present disclosure. The program code instructions 332, when executed by the processor 312 of the processing device 300, may also or instead cause one or more portions or pieces of well construction equipment of a well construction system to perform the example methods and/or operations described herein. The processor 312 may be, comprise, or be implemented by one or more processors of various types suitable to the local application environment, and may include one or more of general-purpose computers, special-purpose computers, microprocessors, digital signal processors (DSPs), field-programmable gate arrays (FPGAs), application-specific integrated circuits (ASICs), and processors based on a multi-core processor architecture, as non-limiting examples. Examples of the processor 312 include one or more INTEL microprocessors, microcontrollers from the ARM and/or PICO families of microcontrollers, embedded soft/hard processors in one or more FPGAs.

The processor 312 may be in communication with a main memory 316, such as may include a volatile memory 318 and a non-volatile memory 320, perhaps via a bus 322 and/or other communication means. The volatile memory 318 may be, comprise, or be implemented by random-access memory (RAM), static RAM (SRAM), dynamic RAM (DRAM), synchronous DRAM (SDRAM), RAMBUS DRAM (RDRAM), and/or other types of RAM devices. The non-volatile memory 320 may be, comprise, or be implemented by read-only memory, flash memory, and/or other types of memory devices. One or more memory controllers (not shown) may control access to the volatile memory 318 and/or non-volatile memory 320.

The processing device 300 may also comprise an interface circuit 324, which is in communication with the processor 312, such as via the bus 322. The interface circuit 324 may be, comprise, or be implemented by various types of standard interfaces, such as an Ethernet interface, a universal serial bus (USB), a third-generation input/output (3GIO) interface, a wireless interface, a cellular interface, and/or a satellite interface, among others. The interface circuit 324 may comprise a graphics driver card. The interface circuit 324 may comprise a communication device, such as a modem or network interface card to facilitate exchange of data with external computing devices via a network (e.g., Ethernet connection, digital subscriber line (DSL), telephone line, coaxial cable, cellular telephone system, satellite, etc.).

The processing device 300 may be in communication with various sensors, video cameras, actuators, processing devices, equipment controllers, and other devices of the well construction system via the interface circuit 324. The interface circuit 324 can facilitate communications between the processing device 300 and one or more devices by utilizing one or more communication protocols, such as an Ethernet-based network protocol (such as ProfiNET, OPC, OPC/UA, Modbus TCP/IP, EtherCAT, UDP multicast, Siemens S7 communication, or the like), a proprietary communication protocol, and/or another communication protocol.

One or more input devices 326 may also be connected to the interface circuit 324. The input devices 326 may permit rig personnel to enter the program code instructions 332, which may be or comprise control data, operational parameters, operational set-points, a well construction drill plan, and/or database of operational sequences. The program code instructions 332 may further comprise modeling or predictive routines, equations, algorithms, processes, applications, and/or other programs operable to perform example methods and/or operations described herein. The input devices 326 may be, comprise, or be implemented by a keyboard, a mouse, a joystick, a touchscreen, a track-pad, a trackball, an isopoint, and/or a voice recognition system, among other examples. One or more output devices 328 may also be connected to the interface circuit 324. The output devices 328 may permit for visualization or other sensory perception of various data, such as sensor data, status data, and/or other example data. The output devices 328 may be, comprise, or be implemented by video output devices (e.g., an LCD, an LED display, a CRT display, a touchscreen, etc.), printers, and/or speakers, among other examples. The one or more input devices 326 and the one or more output devices 328 connected to the interface circuit 324 may, at least in part, facilitate the HMIs described herein.

The processing device 300 may comprise a mass storage device 330 for storing data and program code instructions 332. The mass storage device 330 may be connected to the processor 312, such as via the bus 322. The mass storage device 330 may be or comprise a tangible, non-transitory storage medium, such as a floppy disk drive, a hard disk drive, a compact disk (CD) drive, and/or digital versatile disk (DVD) drive, among other examples. The processing device 300 may be communicatively connected with an external storage medium 334 via the interface circuit 324. The external storage medium 334 may be or comprise a removable storage medium (e.g., a CD or DVD), such as may be operable to store data and program code instructions 332.

As described above, the program code instructions 332 may be stored in the mass storage device 330, the main memory 316, the local memory 314, and/or the removable storage medium 334. Thus, the processing device 300 may be implemented in accordance with hardware (perhaps implemented in one or more chips including an integrated circuit, such as an ASIC), or may be implemented as software or firmware for execution by the processor 312. In the case of firmware or software, the implementation may be provided as a computer program product including a non-transitory, computer-readable medium or storage structure embodying computer program code instructions 332 (i.e., software or firmware) thereon for execution by the processor 312. The program code instructions 332 may include program instructions or computer program code that, when executed by the processor 312, may perform and/or cause performance of example methods, processes, and/or operations described herein.

During rotary drilling operations, just the top drive 116 or both the top drive 116 and the mud motor 182 may rotate the drill bit 126. When just the top drive 116 rotates the drill bit 126, the resulting average drill bit rotational rate is equal to the rotational rate of the top drive 116. When both the top drive 116 and the mud motor 182 rotate the drill bit 126, the resulting average drill bit rotational rate is equal to the sum of rotational rates of the top drive 116 and the mud motor 182. During rotary drilling operations, a lower portion (i.e., the drill bit 126 and/or a portion of the BHA 124) of the drill string 120 may get stuck (e.g., jam or wedge) against the formation 106 in such a manner as to cause the lower portion of the drill string 120 to stop rotating, causing the mud motor 182 (when used) and then the top drive 116 to stall. For example, the drill bit 126 may get stuck against the formation 106 in such a manner that friction between the drill bit 126 and the formation 106 causes the drill bit 126 and the lower portion of the drill string 120 to stop rotating. However, the mud motor 182 and/or a downhole tool 181 may also or instead get stuck against the formation 106 in such a manner that friction between the mud motor 182 and/or the downhole tool 181 and the formation 106 causes the drill bit 126 and the lower portion of the drill string 120 to stop rotating.

Telemetry signals indicative of a stuck event during which the lower portion of the drill string 120 becomes stuck against the subterranean formation 106 may take a relatively long time (e.g., several seconds to a minute or longer) to reach the surface equipment 110 to be detected by the central controller 192 and/or by rig personnel 195 via the workstation 197. Thus, before the stuck lower portion of the drill string 120 is detected, the top drive 116 may continue to rotate and twist the upper end of the drill string 120, resulting in accumulation of torsional energy (i.e., torsional spring or elastic energy) in the drill string 120. Simultaneously, the mud motor 182 (if included in the BHA 124) may rotate and twist the lower end of the drill string 120 above the mud motor 182, resulting in further accumulation of torsional energy (i.e., torsional spring or elastic energy) in the drill string 120 between the top drive 116 and the mud motor 182. After a sufficient amount of torsional energy is accumulated in the drill string 120, the top drive 116 and the mud motor 182 may then stall.

FIGS. 4-8 are graphs 401-405 showing measurements of various operational parameters with respect to time recorded during conventional rotary drilling operations that may be performed by the well construction system 100 shown in FIGS. 1 and 2, before, during, and after the drill bit 126 or a portion of the BHA 124 has become stuck against the formation 106, thereby causing the lower portion of the drill string 120 to stop rotating. Graph 401 shows torque measurements 411 indicative of the torque output by the top drive 116 to the upper end of the drill string 120. Graph 402 shows rotational speed measurements 212 indicative of the rotational speed of the top drive 116 and the upper end of the drill string 120. Graph 403 shows pressure measurements 413 indicative of the pressure of drilling fluid (e.g., measured along the fluid conduit 145) pumped downhole by the mud pumps 144 via the internal fluid passage 121 of the drill string 120. Graph 404 shows position measurements 414 indicative of height of the travelling block 113 (or another portion of the hoisting system 212), and thus indicative of position (i.e., depth) of the BHA 124 above the bottom of the wellbore 102. Graph 405 shows rotational speed measurements 415 indicative of the rotational speed of the drill bit 126.

The operational measurements 411-414 are real-time measurements (also referred to as "hot" measurements) that can be facilitated (e.g., output and/or calculated) by corresponding sensors 231, 232, 233, received and processed by a processing device (e.g., the processing device 300, the surface equipment controller 192, etc.) at the wellsite surface 104, and displayed on a video output device 196 for viewing by rig personnel 195 in real-time. The rotational speed measurements 415 are recorded or delayed measurements (also referred to as "cold" measurements) that can be facilitated (e.g., output and/or calculated) by corresponding sensors 184, 236 while the BHA 124 is downhole, but that are not received and processed by the processing device at the wellsite surface 104 in real-time. The rotational speed measurements 415 may be received and processed by the processing device and displayed on the video output device 196 for viewing by the rig personnel 195 after the BHA 124 is retrieved to the wellsite surface 104 or after telemetry signals comprising the rotational speed measurements 415 are received by processing device at the wellsite surface 104. The operational measurements 411-414 shown in graphs 401-404 are synchronized to the rotational speed measurements 415 shown in graph 405, thereby permitting analysis (e.g., comparison) of trends and behavior of the operational measurements 411-414 generated at the wellsite surface 104 with respect to the rotational speed measurements 415 generated downhole.

The rotational speed measurements 415 shown on graph 405 indicate that the rotational speed of the drill bit 126 fluctuated about a predetermined rotational speed set-point 434 (i.e., drilling speed set-point) and then started to rapidly decrease at time 418 until it reached zero RPM (i.e., the drill bit 126 stopped rotating) at time 420, thereby indicating that the drill bit 126 stopped rotating at time 420. The rotational speed set-point 434 sets or indicates the intended rotational speed of the drill bit 126 and comprises the sum of rotational speed set-point 436 of the top drive 116 and rotational speed set-point (not shown) of the mud motor 182.

The torque measurements 411 shown in graph 401 show torque output by the top drive 116 while the top drive 116 is set to a predetermined torque set-point 426 (i.e., drilling torque set-point) for performing drilling operations. The torque measurements 411 indicate that the torque output by the top drive 116 started to rapidly increase at time 418 until it reached a predetermined maximum torque 422 output by the top drive 116 at time 420. The torque set-point 426 of the top drive 116 sets or indicates the predetermined maximum torque 422 that can be output by the top drive 116.

The rotational speed measurements 412 shown in graph 402 show the rotational speed of the top drive 116 while the top drive 116 is set to the rotational speed set-point 436. The rotational speed measurements 412 indicated that the rotational speed of the top drive 116 (and the top end of the drill string 120) started to rapidly decrease at time 420 until it reached zero RPM at time 424 when the top drive 116 stalled.

The pressure measurements 413 in graph 403 indicate that the pressure of the drilling fluid output by the mud pumps 144 started to increase at time 420 when the drill bit 126 stopped, thereby increasing torque output by the mud motor 182 and further adding torsional energy to the drill string 120. The position measurements 414 in graph 404 indicate that the height of the traveling block 113 stopped decreasing at time 420 when the drill bit 126 stopped, thereby indicating that the drill bit 126 stopped descending into the formation 106. The height of the traveling block 113 then started to increase at time 428, thereby indicating that the drill bit 126 was being lifted. Thus, after the stuck event was detected, the hoisting system 212 (e.g., the drawworks 118) was operated at time 428 to lift the drill bit 126 off of the bottom of the wellbore 102 in an attempt to release the stuck drill bit 126 and/or BHA 124 from the formation 106.

As further shown in graph 405, lifting of the drill string 120 while the torque set-point 426 and the rotational speed set-point 436 of the top drive 116 remain unchanged (i.e., in drilling mode) can cause a sudden and uncontrolled release of torsional energy that has accumulated in the drill string 120 due to continued application (by the top drive 116 to the drill string 120) of maximum torque 422 to the drill string 120 while the drill bit 126 and/or the BHA 124 is stuck. For example, the torque measurements 411 in graph 401 at time 430 indicate a rapid decrease in the torque output by the top drive 116, and the rotational speed measurements 412 in graph 402 at time 430 indicate a rapid increase in rotational speed of the top drive 116, while the drill string 120 is accelerated by the top drive 116 and unwinds to release the accumulated torsional energy in the drill string 120. The pressure measurements 413 in graph 403 indicate a decrease of drilling fluid pressure generated by the mud pumps 144 at time 428 as the drilling fluid experiences less resistance to flow through and out of the mud motor 182 and/or the drill bit 126 when the drill string 120 is lifted off-bottom.

The rotational speed measurements 415 in graph 405 at time 430 indicate a rapid increase in rotational speed, and thus high rotational acceleration of the drill bit 126 and the BHA 124, when the drill bit 126 and/or the BHA 124 becomes free at time 430. The torque supplied by the top drive 116 and the sudden and uncontrolled release of the accumulated torsional energy in the drill string 120 can collectively cause high rotational acceleration, high rotational speed, and/or back spin of the BHA 124. For example, the rotational speed measurements 415 in graph 405 indicate a rapid increase in rotational speed and thus high rotational acceleration of the BHA 124. High rotational acceleration of the BHA 124 can accelerate the BHA 124 to a rotational speed that can spike 432 to levels that are several times (e.g., two, three, four, or more) higher than the rotational speed set-point 436 of the top drive 116 and the rotational speed set-point 434 of the drill bit 434. For example, high rotational acceleration of the BHA 124 can accelerate the BHA 124 from a rotational speed set-point 436 of about 200 RPM to a rotational speed of about 800 RPM. After the drill string 120 is unwound and the accumulated torsional energy is released, the BHA 124 may suddenly and quickly decelerate (i.e., slow down), causing the rotational speed spike 432. Mechanical stress experienced by the BHA 124 caused by the high rotational acceleration and deceleration can damage structural components (e.g., a housing) and/or electronic components (e.g., the sensors 184, the telemetry devices 186, and/or the controllers 188) of the BHA 124 and/or decalibrate the sensors 184.

The present disclosure is further directed to example methods (e.g., operations, processes, actions, etc.) for monitoring and controlling well construction equipment 110 of a well construction system 100. In the following description, one or more descriptors and/or other references to such example methods may not be applicable to the entirety of one or more of the methods. That is, such references may instead be applicable to just one or more aspects of one or more of the methods. Thus, references to "the example methods" are to be understood as being applicable to the entirety of one or more of the methods and/or one or more aspects of one or more of the methods.

The example methods may be performed utilizing or otherwise in conjunction with one or more implementations of one or more instances of one or more components of the apparatus shown in one or more of FIGS. 1-3 and/or otherwise within the scope of the present disclosure. For example, the example methods may be at least partially performed (and/or caused to be performed) by a processing device, such as the processing device 300 executing program code instructions according to one or more aspects of the present disclosure. Thus, the present disclosure is also directed to a non-transitory, computer-readable medium comprising computer program code that, when executed by the processing device, may cause such processing device to perform the example methods described herein. The methods may also or instead be at least partially performed (or be caused to be performed) by a human operator (e.g., rig personnel) utilizing one or more implementations of one or more instances of one or more components of the apparatus shown in one or more of FIGS. 1-3 and/or otherwise within the scope of the present disclosure. Accordingly, the following description refers to apparatus shown in one or more of FIGS. 1-3 and example methods that may be performed by such apparatus. However, the example methods may also be performed in conjunction with implementations of apparatus other than those depicted in FIGS. 1-3 that are also within the scope of the present disclosure.

Example methods according to one or more aspects of the present disclosure may include monitoring predetermined operational parameters of the drill string rotation system 211 and the drilling fluid circulation system 213 during rotary drilling operations to detect a stuck event during which a lower portion (e.g., the drill bit 126 and/or a portion of the BHA 124) of the drill string 120 becomes stuck against a subterranean formation 106 thereby preventing the lower portion of the drill string 120 from rotating. The example methods may further include, after the stuck event is detected, controlling the drill string rotation system 211, the hoisting system 212, and/or the drilling fluid circulation system 213 to release the stored torsional energy from the drill string 120 in a controlled (e.g., slow, gradual, progressive, etc.) manner, such as to prevent, inhibit, or reduce the rotational (i.e., torsional) acceleration and back spin of the BHA 124 associated with the uncontrolled release of the accumulated torsional energy from the drill string 120.

Figure 9:
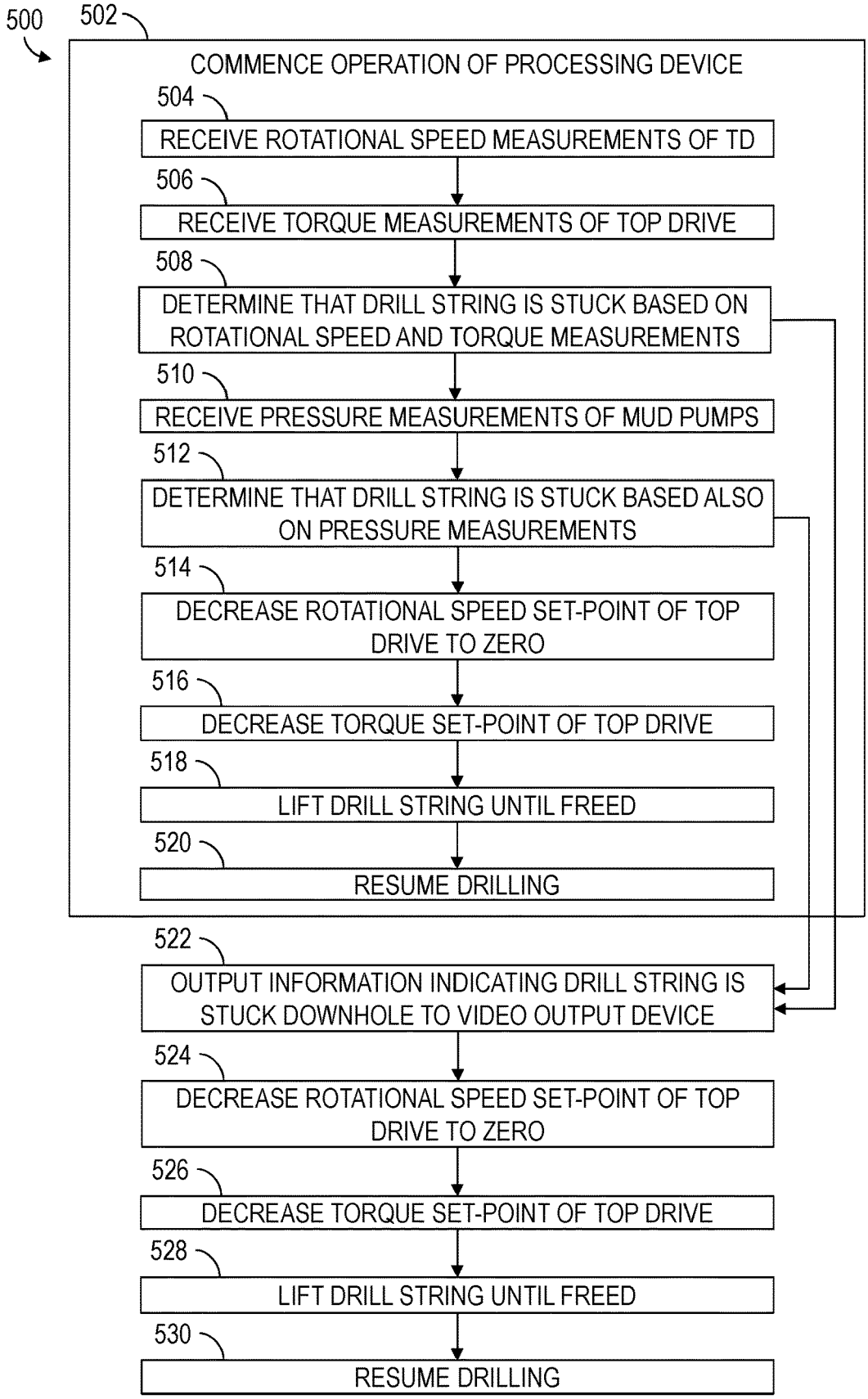
FIG. 9 is flow-chart diagram of at least a portion of an example implementation of a method according to one or more aspects of the present disclosure.
Figure 10:
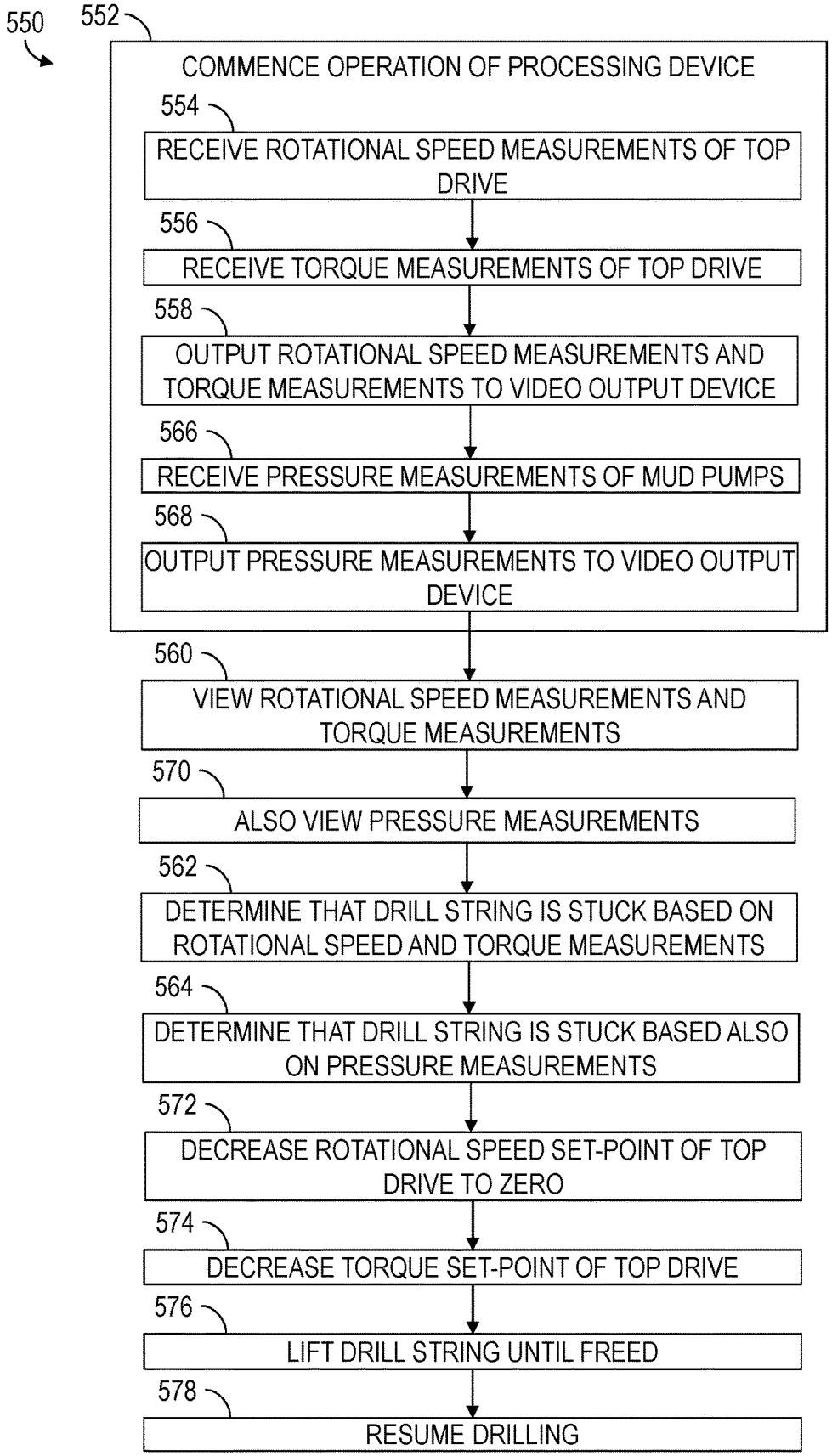
FIG. 10 is flow-chart diagram of at least a portion of an example implementation of another method according to one or more aspects of the present disclosure.
Figure 11:
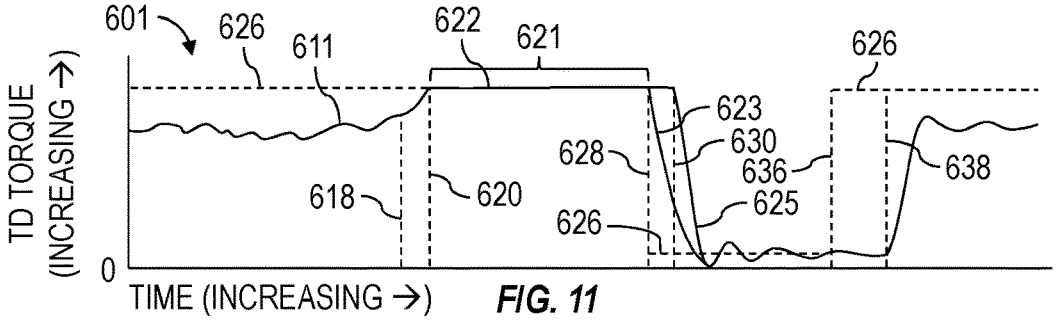
FIGS. 11-15 are graphs according to one or more aspects of the present disclosure.
Figure 12:
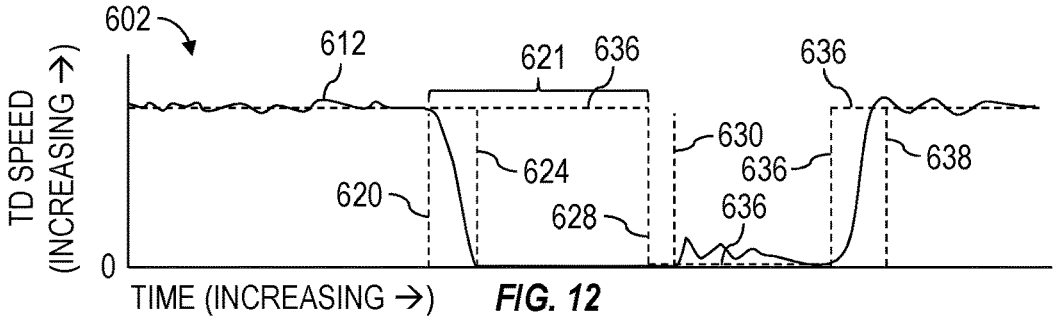
Figure 13:
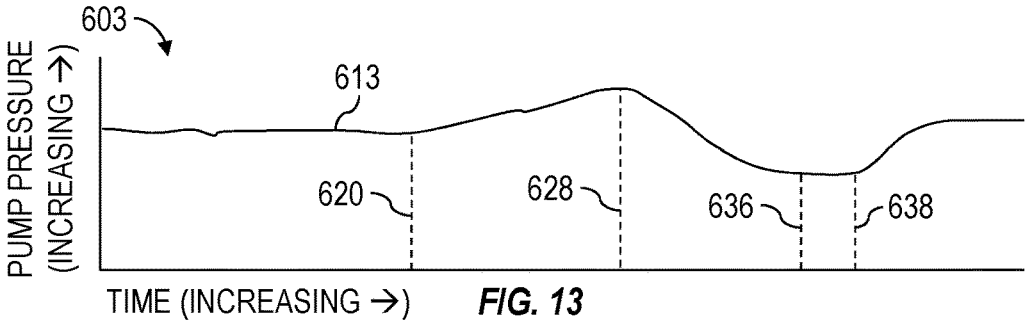
Figure 14:
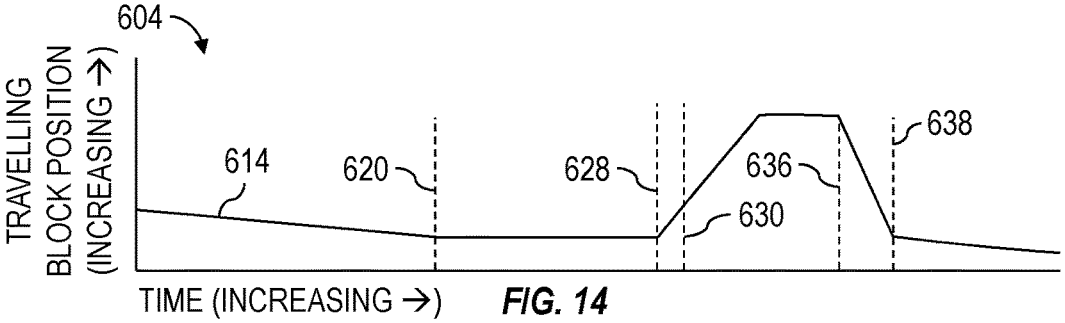
Figure 15:
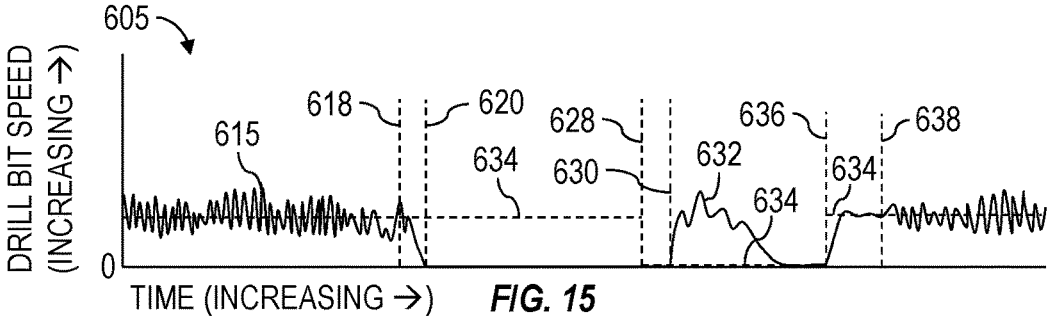

FIG. 9 is a flow-chart diagram of at least a portion of an example implementation of a method 500 for automatically detecting a stuck event of a lower portion (e.g., the drill bit 126 and/or the BHA 124) of the drill string 120 by the processing device 300 and then controlling the drill string rotation system 211 and the hoisting system 212 by the processing device 300 or by rig personnel to release stored torsional energy from the drill string 120 in a controlled manner. FIG. 10 is a flow-chart diagram of at least a portion of an example implementation of a method 550 for detecting a stuck event of a lower portion of the drill string 120 by rig personnel and then controlling the drill string rotation system 211 and the hoisting system 212 by the rig personnel to release stored torsional energy from the drill string 120 in a controlled manner. FIGS. 11-15 are graphs 601-605 showing measurements 611-615 of various operational parameters with respect to time recorded before, during, and after such stuck event while performing the operations (e.g., steps, actions, etc.) of the methods 500, 550. The measurements 611-615 are indicative of the same operational parameters as the measurements 411-415, respectively, except that the measurements 611-615 are indicative of the operational parameters while performing the operations of the methods 500, 550. The example methods 500, 550 may be applicable to a drill string rotation system 211 that does not include the mud motor 182, but includes just the top drive 116 to rotate the drill bit 126. The following description refers to FIGS. 1-3 and 9-15, collectively.

The rotational speed measurements 615 shown on graph 605 indicate that the rotational speed of the drill bit 126 fluctuates about a predetermined rotational speed set-point 634 of the drill bit 126, then starts to rapidly decrease at time 618, and then reaches zero RPM (i.e., the drill bit 126 stops rotating) at time 620, thereby indicating that the drill string 120 became stuck at time 620. Because the BHA 124 does not include a mud motor 182, the predetermined rotational speed set-point 634 of the drill bit 126 is equal to a predetermined rotational speed set-point 636 of the top drive 116. The torque measurements 611 shown in graph 601 show the torque output by the top drive 116 while the top drive 116 is set to a predetermined torque set-point 626 (i.e., drilling torque set-point) for performing drilling operations. The torque measurements 611 indicate that the torque output by the top drive 116 starts to rapidly increase at time 618 until it reaches, at time 620, a predetermined maximum level of torque 622 that the top drive 116 can output. The rotational speed measurements 612 shown in graph 602 show the rotational speed of the top drive 116 while the top drive 116 is set to the rotational speed set-point 636 for performing the drilling operations. The rotational speed measurements 612 indicate that the rotational speed of the top drive 116 (and the top end of the drill string 120) starts to rapidly decrease at time 620 until it reaches zero RPM (i.e., the top drive 116 stops rotating) at time 624. The pressure measurements 613 in graph 603 indicate that the pressure of the drilling fluid (i.e., the drilling mud) output by the mud pumps 144 starts to increase at time 620 when the drill bit 126 stops. The position measurements 614 in graph 604 indicate that the height of the traveling block 113 stops decreasing at time 620 when the drill bit 126 stops, thereby indicating that the drill string 120 stopped descending into the formation 106.

The method 500 may comprise commencing operation 502 of the processing device 300 (e.g., the surface equipment controller 192) of the well construction system 100 for drilling the well 102. Commencing operation of the processing device 300 may cause the processing device 300 to execute the computer program code 332, thereby causing the processing device 300 to perform at least a portion of the method 500.

Commencing operation 502 of the processing device 300 may cause the processing device 300 to determine 508 that a lower portion of the drill string 120 (e.g., the drill bit and/or the BHA 124) has become stuck downhole based on the rotational speed measurements 612 and the torque measurements 611 of the top drive 116. For example, the processing device 300 may receive 504 the rotational speed measurements 612 indicative of rotational speed of the top drive 116 and receive 506 the torque measurements 611 indicative of torque output by the top drive 116 to the drill string 120. The processing device 300 may then determine 508 that the drill string 120 has become stuck downhole when the rotational speed measurements 612 indicate that the rotational speed of the top drive 116 is decreasing and the torque measurements 611 indicate that the torque output by the top drive 116 has increased to the predetermined maximum torque output level 622 of the top drive 116. The processing device 300 may determine 508 that the drill string 120 has become stuck downhole when the rotational speed measurements 612 indicate that the rotational speed of the top drive 116 has decreased to zero RPM (i.e., the top drive 116 stopped rotating) at time 624 and the torque measurements 611 indicate that the torque output by the top drive 116 has increased to the predetermined maximum torque output level 622 of the top drive 116. Alternatively, the processing device 300 may determine 508 that the drill string 120 has become stuck downhole when the rotational speed measurements 612 indicate that the rotational speed of the top drive 116 is decreasing, but before the rotational speed of the top drive 116 decreases to zero RPM at time 624, and the torque measurements 611 indicate that the torque output by the top drive 116 has increased to the predetermined maximum torque output level 622 of the top drive 116. Still alternatively, the processing device 300 may determine 508 that the drill string 120 has become stuck downhole when the rotational speed measurements 612 indicate that the rotational speed of the top drive 116 is decreasing and the torque measurements 611 indicate that the torque output by the top drive 116 has increased to the predetermined maximum torque output level 622 of the top drive 116 for a predetermined period of time 621 that starts at time 620 and ends at time 628. Such period of time 621 may be about one second, two seconds, three seconds, four seconds, five seconds, or longer. The predetermined period of time 621 may end at time 628, which may be before or after time 624 at which the top drive 116 stopped rotating. Although graph 602 shows the time 628 (i.e., time at which the processing device 300 determined 508 that the drill string 120 became stuck downhole) being after time 624, it is to be understood that events associated with time 628 may take place before time 624, at which the top drive 116 stops rotating. Accordingly, the predetermined period of time 621 may be shorter or longer than the length of time between time 620 and time 624.

The processing device 300 may determine 512 that a portion of the drill string 120 has become stuck downhole based also on pressure measurements 613 of drilling fluid pumped downhole by the mud pumps 144 via the internal fluid passage 121 of the drill string 120. For example, the processing device 300 may receive 510 pressure measurements 613 indicative of the pressure of the drilling fluid being pumped by the mud pumps 144 into the drill string 120 and determine 512 that the drill string 120 has become stuck downhole when, in addition to the scenarios described above, the pressure measurements 613 also indicate that the pressure output by the mud pumps 144 is increasing.

When the processing device 300 determines 508, 512 that a lower portion of the drill string 120 became stuck downhole at time 628, the processing device 300 may automatically control the top drive 116 and the drawworks 118 to release the stored torsional energy from the drill string 120 in a controlled manner. For example, after the processing device 300 determines 508, 512 that the drill string 120 has become stuck, the processing device 300 may automatically decrease 514 the rotational speed set-point 636 of the top drive 116 to zero RPM and decrease 516 the torque set-point 626 of the top drive 116 to a predetermined torque level. Decreasing 514 the rotational speed set-point 636 to zero RPM causes the processing device 300 to output a control signal indicative of the rotational speed set-point 636 of zero RPM to the top drive 116. Decreasing 516 the torque set-point 626 of the top drive 116 to the predetermined torque level causes the processing device 300 to output a control signal indicative of the torque set-point 626 to the top drive 116, thereby preventing or inhibiting the drill string 120 from being twisted further by the top drive 116, and thus preventing or inhibiting additional torsional energy from being stored in the drill string 120. The predetermined torque level indicated by the torque set-point 626 may be or comprise the minimum (i.e., the lowest) torque level that the top drive 116 can output to the drill string 120. The predetermined torque level indicated by the torque set-point 626 may be or comprise a torque level of zero, which causes the top drive 116 not to output torque to the drill string 120 at time 628.

Decreasing 514 the rotational speed set-point 636 of the top drive 116 to zero RPM and decreasing 516 the torque set-point 626 of the top drive 116 at time 628 may cause the top drive 116 to permit being rotated backward by the torsional energy accumulated in the drill string 120. Backward rotation of the top drive 120 may permit the drill string 120 to unwind in a controlled manner, thereby slowly dissipating the torsional energy accumulated in the drill string 120, as indicated by segment 623 of the torque measurements 611. The torsional energy accumulated in the drill string 120 may thus be released in a controlled manner by the top drive 116, which dissipates the accumulated torsional energy while being rotated backward by the torsional energy. If decreasing 514 the rotational speed set-point 636 of the top drive 116 to zero RPM and decreasing 516 the torque set-point 626 of the top drive 116 does not cause the top drive 116 to permit being rotated backward by the torsional energy accumulated in the drill string 120, the accumulated torsional energy may be released from the drill string 120 upon the stuck portion of the drill string 120 being freed from the formation 106 at time 630, as indicated by segment 625 of the torque measurements 611. However, because the top drive 116 is no longer applying torque (or is applying just a small amount of torque) to the drill string 120 when the drill string 120 becomes free at time 630, the rotational acceleration experienced by the BHA 124 may be significantly lower when the drill string 120 becomes free.

After the processing device 300 decreases 514 the rotational speed set-point 636 of the top drive 116 to zero RPM and decreases 516 the torque set-point 626 of the top drive 116 to the predetermined torque level at time 628, the processing device 300 may then automatically cause a drawworks 118 to lift 518 the drill string 120 until the drill string 120 (e.g., the drill bit 126 and/or the BHA 124) has been freed from the formation 106 at time 630. The processing device 300 may determine that the drill string 120 has been freed from the formation 106 when, for example, the pressure measurements 613 indicate that the drilling fluid pressure output by the mud pumps 144 is decreasing, which in turn indicates that drilling fluid ports of the drill bit 126 are retreated from the bottom of the wellbore 102 by a distance sufficient to permit the drilling fluid to resume flow out of the drill string 120. A decrease of drilling fluid pressure output by the mud pumps 144 may also indicate that the drill bit 126 is rotating, which permits the drilling fluid to pass more freely through the mud motor 182. The processing device 300 may also or instead determine that the drill string 120 has been freed from the formation 106 when, for example, the drawworks 118 experiences a decrease in weight of the drill string 120, thereby indicating a decreased friction between the drill string 120 and the formation 106.

For a top drive 116 that does not permit reverse rotation, the processing device 300 may also or instead determine that the drill string 120 has been freed from the formation 106 when, for example, the torque measurements 611 indicate that the torque output by the top drive 116 is decreasing, thereby indicating that the drill string 120 is free from the formation 106 and able to rotate.

Upon the drill string 120 becoming free from the formation 106 at time 630, the rotational speed measurements 615 may indicate a slower increase in rotational speed, and thus lower acceleration of the BHA 124 and the drill bit 126, relative to the rotational speed measurements 415 shown in graph 405. The controlled release of the accumulated torsional energy in the drill string 120 caused by the dampening effect of the top drive 116, the decrease 514 of the rotational speed set-point 636 of the top drive 116, and/or the decrease 516 of the torque set-point 626 of the top drive 116 to a predetermined torque level, collectively decrease rotational speed spike 632 and the associated rotational acceleration of the drill bit 126 and the BHA 124.

After the drill string 120 becomes free from the formation 106, the processing device 300 may automatically resume 520 the drilling operations. For example, at time 636, the processing device 300 may automatically increase the rotational speed set-point 636 of the top drive 116 to a predetermined rotational speed, increase the torque set-point 626 of the top drive 116 to a predetermined torque, and cause the drawworks 118 to lower the drill string 120. The drill string 120 may be lowered until the drill bit 126 contacts the bottom of the wellbore 102 at time 638 to continue the drilling operations.

Instead of the processing device 300 automatically controlling the top drive 116 and the drawworks 118 to release the stored torsional energy from the drill string 120 in the controlled manner, rig personnel may manually control the top drive 116 and the drawworks 118 via the control workstation 197 to release the stored torsional energy from the drill string 120 in the controlled manner. For example, after the processing device 300 determines 508, 512 that the drill string 120 has become stuck, the processing device 300 may output 522 information indicating that the drill string 120 became stuck to the video output device 196 for viewing by the rig personnel. The rig personnel may then decrease 524 the rotational speed set-point of the top drive 116 to zero RPM, decrease 526 the torque set-point of the top drive 116, and then operate the drawworks 118 to lift 528 the drill string 120 to free the drill string 120 from the formation 106. The position measurements 614 in graph 604 show that the height of the traveling block 113 started to increase at time 628, thereby indicating that the drill string 120 was being lifted 528. Thus, after the stuck drill string 120 was detected, the hoisting system 212 (e.g., the drawworks 118) was operated at time 628 to lift the drill string 120 (and the drill bit 126) from the bottom of the wellbore 102 in an attempt to release the drill string 120 from the formation 106.

The rig personnel may then determine if the drill string 120 has been freed from the formation 106 based on various operational measurements described above and displayed on the video output device 196. For example, the rig personnel may determine if the drill string 120 has been freed from the formation 106 when the pressure measurements 613 indicate that the drilling fluid pressure output by the mud pumps 144 is decreasing, when the drawworks 118 experiences a decrease in weight of the drill string 120, and/or when the torque measurements 611 indicate that the torque output by the top drive 116 is decreasing. After the drill string 120 becomes free from the formation 106, the rig personnel may resume 530 the drilling operations. For example, at time 636, the rig personnel may increase the rotational speed set-point 636 of the top drive 116 to a predetermined rotational speed, increase the torque set-point 626 of the top drive 116 to a predetermined torque, and cause the drawworks 118 to lower the drill string 120. The drill string 120 may be lowered until the drill bit 126 contacts the bottom of the wellbore 102 at time 638 to continue the drilling operations.

The method 550 may comprise commencing operation 552 of a processing device 300 (e.g., the surface equipment controller 192) of a well construction system 100 for drilling a well 102. Commencing operation of the processing device 300 may cause the processing device 300 to execute a computer program code 332, thereby causing the processing device 300 to perform at least a portion of the method 550.

Commencing operation 552 of the processing device 300 may cause the processing device 300 to receive 554 rotational speed measurements 612 indicative of rotational speed of a top drive 116 rotating a drill string 120 and receive 556 torque measurements 611 indicative of torque output by the top drive 116 to the drill string 120. The processing device 300 may then output 558 the torque measurements 611 and the rotational speed measurements 612 to the video output device 196 for viewing by rig personnel. For example, the processing device 300 may output 558 the torque measurements 611 and the rotational speed measurements 612 to the video output device 196 in the form of graphs 601, 602, respectively.

The rig personnel may then view 560 the rotational speed measurements 612 and the torque measurements 611 displayed on the video output device 196 and determine 562 that the drill string 120 has become stuck downhole based on the displayed rotational speed measurements 612 and torque measurements 611. For example, the rig personnel may determine 562 that the drill string 120 has become stuck downhole when the rotational speed measurements 612 indicate that the rotational speed of the top drive 116 is decreasing and the torque measurements 611 indicate that the torque output by the top drive 116 has increased to a predetermined maximum torque output level 622 of the top drive 116. The rig personnel may determine 562 that the drill string 120 has become stuck downhole when the rotational speed measurements 612 indicate that the rotational speed of the top drive 116 has decreased to zero RPM at time 624 and the torque measurements 611 indicate that the torque output by the top drive 116 has increased to the predetermined maximum torque output level 622 of the top drive 116. Alternatively, the rig personnel may determine 562 that the drill string 120 has become stuck downhole when the rotational speed measurements 612 indicate that the rotational speed of the top drive 116 is decreasing, but before the rotational speed of the top drive 116 has decreased to zero RPM at time 624, and the torque measurements 611 indicate that the torque output by the top drive 116 has increased to the predetermined maximum torque output level 622 of the top drive 116. Still alternatively, the rig personnel may determine 562 that the drill string 120 has become stuck downhole when the rotational speed measurements 612 indicate that the rotational speed of the top drive 116 is decreasing and the torque measurements 611 indicate that the torque output by the top drive 116 has increased to the predetermined maximum torque output level 622 of the top drive 116 for a predetermined period of time 621 that starts at time 620 and ends at time 628.

The rig personnel may determine 564 that the drill string 120 has become stuck downhole based also on pressure measurements 613 of the mud pumps 144. For example, operating 552 the processing device 300 may further cause the processing device 300 to receive 566 the pressure measurements 613 indicative of the pressure of drilling fluid being pumped by the mud pumps 144 into the drill string 120. The processing device 300 may then output 568 the pressure measurements 613 to the video output device 196 for viewing by the rig personnel. For example, the processing device 300 may output 568 the pressure measurements 613 to the video output device 196 in the form of graph 603. The rig personnel may then view 570 the pressure measurements 613 displayed on the video output device 196 and determine 564 that the drill string 120 has become stuck downhole when, in addition to the changes in rotational speed measurements 612 and torque measurements 611 described above, the pressure measurements 613 also indicate that the pressure output by the mud pumps 144 is increasing.

When the rig personnel determines 562, 564 that the drill string 120 has become stuck downhole at time 628, the rig personnel may control the top drive 116 and the drawworks 118 to release the stored torsional energy from the drill string 120 in the controlled manner. For example, after the rig personnel determines 562, 564 that the drill string 120 has become stuck, the rig personnel may decrease 572 a rotational speed set-point 636 of the top drive 116 to zero RPM and decrease 574 a torque set-point 626 of the top drive 116 to a predetermined torque level, thereby preventing or inhibiting the drill string 120 to be twisted further by the top drive 116, and thus preventing or inhibiting additional torsional energy to be stored in the drill string 120. The predetermined torque level indicated by the torque set-point 626 may be or comprise the minimum torque level that the top drive 116 can output to the drill string 120. The predetermined torque level indicated by the torque set-point 626 may be or comprise a torque level of zero, which causes the top drive 116 not to output torque to the drill string 120 at time 628.

Decreasing 572 the rotational speed set-point 636 of the top drive 116 to zero RPM and decreasing 574 the torque set-point 626 of the top drive 116 at time 628 may cause the top drive 116 to permit being rotated backward by the torsional energy accumulated in the drill string 120. Backward rotation of the top drive 120 may permit the drill string 120 to unwind in a controlled manner, thereby slowly dissipating the torsional energy accumulated in the drill string 120, as indicated by segment 623 of the torque measurements 611. The torsional energy accumulated in the drill string 120 may thus be released in a controlled manner by the top drive 116, which dissipates the torsional energy while being rotated backward by the torsional energy. If decreasing 572 the rotational speed set-point of the top drive 116 to zero RPM and decreasing 574 the torque set-point of the top drive 116 does not cause the top drive 116 to permit being rotated backward by the torsional energy accumulated in the drill string 120, the torsional energy may be released from the drill string 120 upon the drill string 120 being freed from the formation 106 at time 630, as indicated by segment 625 of the torque measurements 611. However, because the top drive 116 is no longer applying torque (or applying just a small amount of torque) to the drill string 120 when the drill string 120 becomes free at time 630, the rotational acceleration experienced by the BHA 124 may be significantly lower when the drill string 120 becomes free.

After the rig personnel decreases 572 the rotational speed set-point 636 of the top drive 116 to zero RPM and decreases 574 the torque set-point 626 of the top drive 116 to the predetermined torque level at time 628, the rig personnel may then cause a drawworks 118 to lift 576 the drill string 120 until the drill string 120 has been freed from the formation 106 at time 630. The rig personnel may determine that the drill string 120 has been freed from the formation 106 when, for example, the pressure measurements 613 indicate that the drilling fluid pressure output by the mud pumps 144 is decreasing. The rig personnel may also or instead determine that the drill string 120 has been freed from the formation 106 when, for example, the drawworks 118 experiences a decrease in weight of the drill string 120. For a top drive 116 that does not permit reverse rotation, the rig personnel may determine that the drill string 120 has been freed from the formation 106 when, for example, the torque measurements 611 indicate that the torque output by the top drive 116 is decreasing, thereby indicating that the drill string 120 is free from the formation 106 and free to rotate.

Upon the drill string 120 becoming free from the formation 106 at time 630, the rotational speed measurements 615 indicate a slow increase in rotational speed, and thus lower acceleration of the BHA 124 and the drill bit 126 relative to the rotational speed measurements 415 shown in graph 405. The controlled release of the accumulated torsional energy in the drill string 120 caused by the dampening effect of the top drive 116, the decrease 572 of the rotational speed set-point 636 of the top drive 116, and/or the decrease 574 of the torque set-point 626 of the top drive 116, collectively decrease rotational speed spike 632 and the associated rotational acceleration of the drill bit 126 and the BHA 124.

After the drill string 120 becomes free from the formation 106, the rig personnel may resume 578 the drilling operations. For example, at time 636, the rig personnel may increase the rotational speed set-point 636 of the top drive 116 to a predetermined rotational speed, increase the torque set-point 626 of the top drive 116 to a predetermined torque, and cause the drawworks 118 to lower the drill string 120. The drill string 120 may be lowered until the drill bit 126 contacts the bottom of the wellbore 102 at time 638 to continue the drilling operations.

Figure 16:
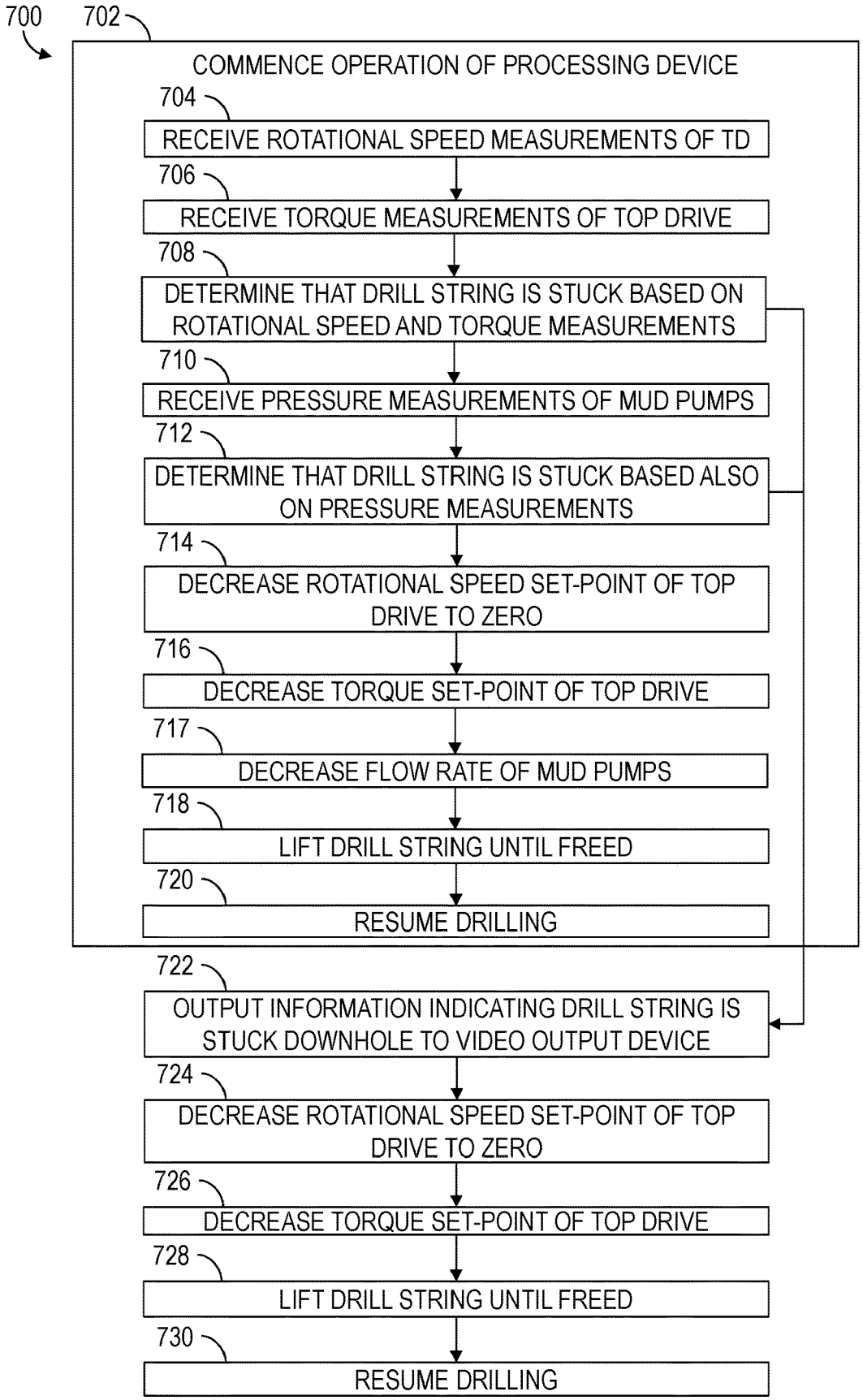
FIG. 16 is flow-chart diagram of at least a portion of an example implementation of a method according to one or more aspects of the present disclosure.
Figure 17:
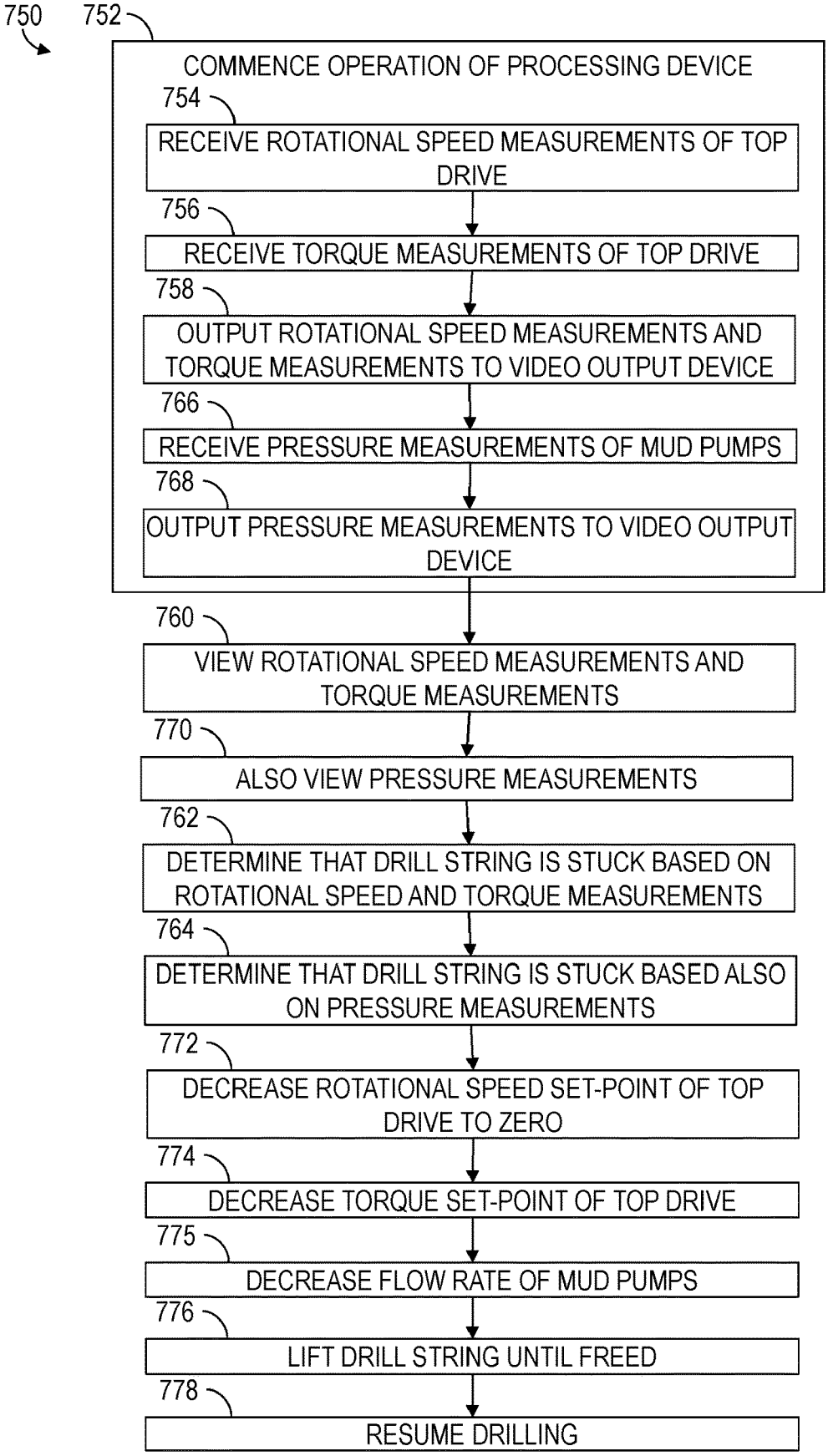
FIG. 17 is flow-chart diagram of at least a portion of an example implementation of another method according to one or more aspects of the present disclosure.
Figure 18:
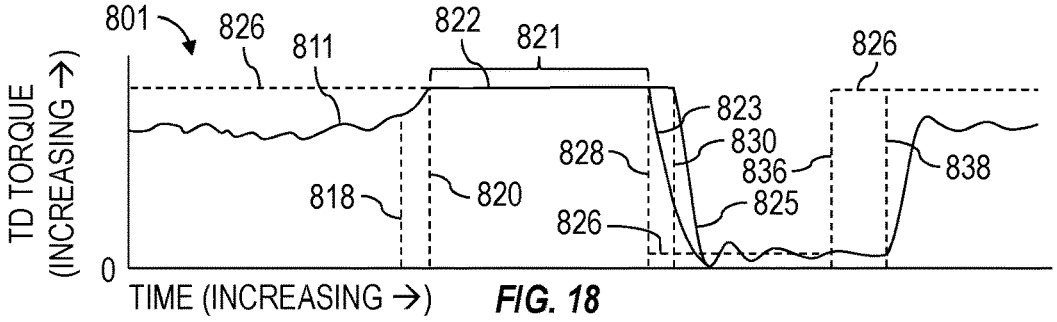
FIGS. 18-23 are graphs according to one or more aspects of the present disclosure.
Figure 19:
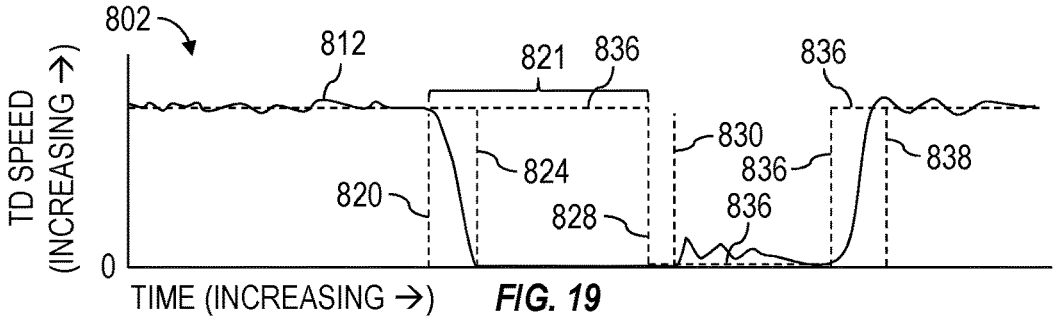
Figure 20:
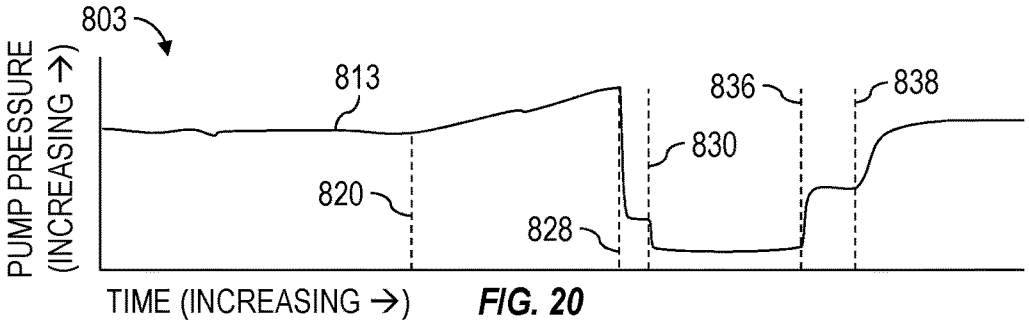
Figure 21:
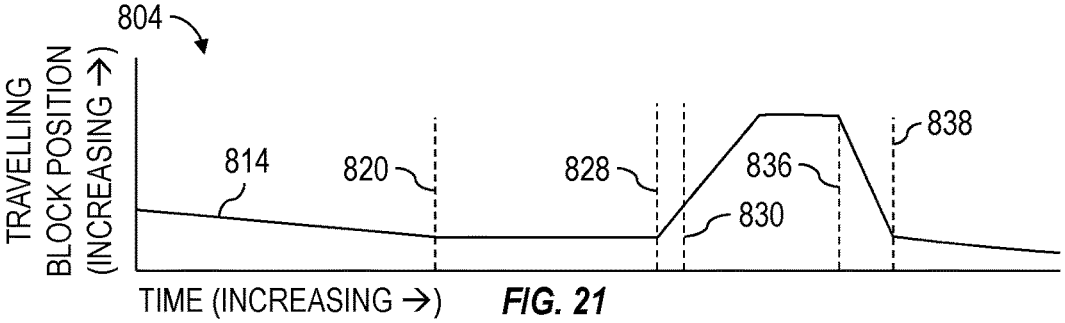
Figure 22:
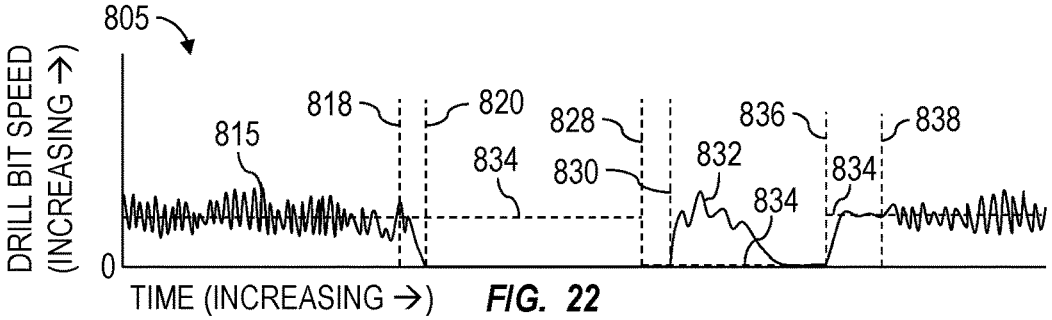

FIG. 16 is a flow-chart diagram of at least a portion of an example implementation of a method 700 for automatically detecting a stuck event of a lower portion (e.g., the drill bit 126 and/or the BHA 124) of the drill string 120 by the processing device 300 and then controlling the drill string rotation system 211 and the hoisting system 212 by the processing device 300 or by rig personnel to release stored torsional energy from the drill string 120 in a controlled manner. FIG. 17 is a flow-chart diagram of at least a portion of an example implementation of a method 750 for detecting a stuck event of a lower portion of the drill string 120 by rig personnel and then controlling the drill string rotation system 211 and the hoisting system 212 by the rig personnel to release stored torsional energy from the drill string 120 in a controlled manner. FIGS. 18-22 are graphs 801-805 showing measurements 811-815 of various operational parameters with respect to time recorded before, during, and after such stuck events while performing the operations (e.g., steps, actions, etc.) of the methods 700, 750. The measurements 811-815 are indicative of the same operational parameters as the measurements 411-415, respectively, except that the measurements 811-815 are indicative of the operational parameters while performing the operations of the methods 700, 750. The example methods 700, 750 may be applicable to a drill string rotation system 211 that includes the mud motor 182 in addition to the top drive 116 to rotate the drill bit 126. The following description refers to FIGS. 1-3 and 16-22, collectively.

The rotational speed measurements 815 shown on graph 805 indicate that the rotational speed of the drill bit 126 fluctuates about a predetermined rotational speed set-point 834 of the drill bit 126, then starts to rapidly decrease at time 818, and then reaches zero RPM (i.e., the drill bit 126 stops rotating) at time 820, thereby indicating that the drill string 120 became stuck at time 820. The torque measurements 811 shown in graph 801 show the torque output by the top drive 116 while the top drive 116 is set to a predetermined torque set-point 826 (i.e., drilling torque set-point) for performing drilling operations. The torque measurements 811 indicate that the torque output by the top drive 116 starts to rapidly increase at time 818 until it reaches, at time 820, a predetermined maximum torque 822 that the top drive 116 can output. The rotational speed measurements 812 shown in graph 802 show the rotational speed of the top drive 116 while the top drive 116 is set to a rotational speed set-point 836. The rotational speed measurements 812 indicate that the rotational speed of the top drive 116 (and the top end of the drill string 120) starts to rapidly decrease at time 820 until it reaches zero RPM (i.e., the top drive 116 stops rotating) at time 824. The pressure measurements 813 in graph 803 indicate that the pressure of the drilling fluid (i.e., the drilling mud) output by the mud pumps 144 starts to increase at time 820 when the drill bit 126 stops. The position measurements 814 in graph 804 indicate that the height of the traveling block 113 stops decreasing at time 820 when the drill bit 126 stops, thereby indicating that the drill string 120 stopped descending into the formation 106.

The method 700 may comprise commencing operation 702 of the processing device 300 (e.g., the surface equipment controller 192) of the well construction system 100 for drilling the well 102. Commencing operation of the processing device 300 may cause the processing device 300 to execute the computer program code 332, thereby causing the processing device 300 to perform at least a portion of the method 700.

Commencing operation 702 of the processing device 300 may cause the processing device 300 to determine 708 that a lower portion of the drill string 120 (e.g., the drill bit and/or the BHA 124) has become stuck downhole based on the rotational speed measurements 812 and the torque measurements 811 of the top drive 116. For example, the processing device 300 may receive 704 the rotational speed measurements 812 indicative of rotational speed of the top drive 116 and receive 706 the torque measurements 811 indicative of torque output by the top drive 116 to the drill string 120. The processing device 300 may then determine 708 that the drill string 120 has become stuck downhole when the rotational speed measurements 812 indicate that the rotational speed of the top drive 116 is decreasing and the torque measurements 811 indicate that the torque output by the top drive 116 has increased to the predetermined maximum torque output level 822 of the top drive 116. The processing device 300 may determine 708 that the drill string 120 has become stuck downhole when the rotational speed measurements 812 indicate that the rotational speed of the top drive 116 has decreased to zero RPM (i.e., the top drive 116 stopped rotating) at time 824 and the torque measurements 811 indicate that the torque output by the top drive 116 has increased to the predetermined maximum torque output level 822 of the top drive 116. Alternatively, the processing device 300 may determine 708 that the drill string 120 has become stuck downhole when the rotational speed measurements 812 indicate that the rotational speed of the top drive 116 is decreasing, but before the rotational speed of the top drive 116 decreases to zero RPM at time 824, and the torque measurements 811 indicate that the torque output by the top drive 116 has increased to the predetermined maximum torque output level 822 of the top drive 116. Still alternatively, the processing device 300 may determine 708 that the drill string 120 has become stuck downhole when the rotational speed measurements 812 indicate that the rotational speed of the top drive 116 is decreasing and the torque measurements 811 indicate that the torque output by the top drive 116 has increased to the predetermined maximum torque output level 822 of the top drive 116 for a predetermined period of time 821 that starts at time 820 and ends at time 828. Such period of time 821 may be about one second, two seconds, three seconds, four seconds, five seconds, or longer. The predetermined period of time 821 may end at time 828, which may be before or after time 824 at which the top drive 116 stopped rotating. Although graph 802 shows the time 828 (i.e., time at which the processing device 300 determined 708 that the drill string 120 became stuck downhole) being after time 824, it is to be understood that events associated with time 828 may take place before time 824, at which the top drive 116 stops rotating. Accordingly, the predetermined period of time 821 may be shorter or longer than the length of time between time 820 and time 824.

The processing device 300 may determine 712 that a portion of the drill string 120 has become stuck downhole based also on pressure measurements 813 of drilling fluid pumped downhole by the mud pumps 144 via the internal fluid passage 121 of the drill string 120. For example, the processing device 300 may receive 710 pressure measurements 813 indicative of the pressure of the drilling fluid being pumped by the mud pumps 144 into the drill string 120 and determine 712 that the drill string 120 has become stuck downhole when, in addition to the scenarios described above, the pressure measurements 813 also indicate that the pressure output by the mud pumps 144 is increasing.

When the processing device 300 determines 708, 712 that a lower portion of the drill string has become stuck downhole at time 828, the processing device 300 may automatically control the top drive 116 and the drawworks 118 to release the stored torsional energy from the drill string 120 in a controlled manner. For example, after the processing device 300 determines 708, 712 that the drill string 120 has become stuck, the processing device 300 may at time 828 automatically decrease 714 the rotational speed set-point 836 of the top drive 116 to zero RPM, decrease 716 the torque set-point 826 of the top drive 116 to a predetermined torque level, and decrease 717 flow rate of the drilling fluid being pumped downhole by the mud pumps 144. Decreasing 714 the rotational speed set-point 836 to zero RPM causes the processing device 300 to output a control signal indicative of the rotational speed set-point 836 of zero RPM to the top drive 116. Decreasing 716 the torque set-point 826 of the top drive 116 to the predetermined torque level causes the processing device 300 to output a control signal indicative of the torque set-point 826 to the top drive 116.

The predetermined torque level indicated by the torque set-point 826 may be or comprise the minimum (i.e., the lowest) torque level that the top drive 116 can output to the drill string 120. The predetermined torque level indicated by the torque set-point 826 may be or comprise a torque level of zero, which causes the top drive 116 not to output torque to the drill string 120. The flow rate of the drilling fluid may be decreased 717 to a level that facilitates sufficient electrical power to be generated downhole by a turbine to maintain downhole electrical devices (e.g., the sensors 184, the telemetry devices 186, and/or the controllers 188) of the BHA 124 electrically powered. For example, the flow rate of the drilling fluid may be decreased 717 to a flow rate that ranges between about 5% and about 25% above a "turn on" flow rate, which is a minimum flow rate of the drilling fluid which facilitates generation of sufficient electrical power to maintain the downhole electrical devices of the BHA 124 electrically powered. Decreasing 714 the rotational speed set-point 836 of the top drive 116 to zero RPM and decreasing 716 the torque set-point 826 of the top drive 116 at time 828 may prevent or inhibit the drill string 120 from being twisted further by the top drive 116 and thereby prevent or inhibit additional torsional energy from being stored in the drill string 120. Decreasing 717 the flow rate of the drilling fluid being pumped downhole by the mud pumps 144 at time 828 may decrease downhole pressure of the drilling fluid at the mud motor 182 and thereby decrease torque output by the mud motor 182 to the drill bit 126. Decreasing torque output by the mud motor 182 to the drill bit 126 may in turn prevent or inhibit the drill string 120 from being twisted further by the mud motor 182, and thus prevent or inhibit additional torsional energy from being stored in the drill string 120.

Decreasing 714 the rotational speed set-point 836 of the top drive 116 to zero RPM and decreasing 716 the torque set-point 826 of the top drive 116 at time 828 may cause the top drive 116 to permit being rotated backward by the torsional energy accumulated in the drill string 120. Backward rotation of the top drive 120 may permit the drill string 120 to unwind in a controlled manner, thereby slowly dissipating the torsional energy accumulated in the drill string 120, as indicated by segment 823 of the torque measurements 811. The torsional energy accumulated in the drill string 120 may thus be released in a controlled manner by the top drive 116, which dissipates the accumulated torsional energy while being rotated backward by the torsional energy. If decreasing 714 the rotational speed set-point 836 of the top drive 116 to zero RPM and decreasing 716 the torque set-point 826 of the top drive 116 does not cause the top drive 116 to permit being rotated backward by the torsional energy accumulated in the drill string 120, the accumulated torsional energy may be released from the drill string 120 upon the stuck portion of the drill string 120 being freed from the formation 106 at time 830, as indicated by segment 825 of the torque measurements 811. However, because the top drive 116 is no longer applying torque (or is applying just a small amount of torque) to the drill string 120 and the mud motor 182 is applying a significantly lower torque to the drill string 120 when the drill string 120 becomes free at time 830, the rotational acceleration experienced by the BHA 124 may be significantly lower when the drill string 120 becomes free.

After the processing device 300 decreases 714 the rotational speed set-point 836 of the top drive 116, decreases 716 the torque set-point 826 of the top drive 116, and decreases 717 the flow rate of the drilling fluid being pumped downhole by the mud pumps 144, the processing device 300 may then automatically cause the drawworks 118 to lift 718 the drill string 120 until the drill string 120 (e.g., the drill bit 126 and/or the BHA 124) has been freed from the formation 106 at time 830. The processing device 300 may determine that the drill string 120 has been freed from the formation 106 when, for example, the pressure measurements 813 indicate that the drilling fluid pressure output by the mud pumps 144 decreases further after the flow rate of the drilling fluid was decreased 717. An additional decrease, such as shown at time 830, may indicate that drilling fluid ports of the drill bit 126 retreated from the bottom of the wellbore 102 by a distance sufficient to permit the drilling fluid to resume flow out of the drill string 120. An additional decrease of drilling fluid pressure output by the mud pumps 144 may also indicate that the drill bit 126 is rotating, which permits the drilling fluid to pass more freely through the mud motor 182. The processing device 300 may also or instead determine that the drill string 120 has been freed from the formation 106 when, for example, the drawworks 118 experiences a decrease in weight of the drill string 120, thereby indicating a decreased friction between the drill string 120 and the formation 106. For a top drive 116 that does not permit reverse rotation, the processing device 300 may also or instead determine that the drill string 120 has been freed from the formation 106 when, for example, the torque measurements 811 indicate that the torque output by the top drive 116 is decreasing, thereby indicating that the drill string 120 is free from the formation 106 and able to rotate.

Upon the drill string 120 becoming free from the formation 106 at time 830, the rotational speed measurements 815 may indicate a slower increase in rotational speed, and thus lower acceleration of the BHA 124 and the drill bit 126, relative to the rotational speed measurements 415 shown in graph 405. The controlled release of the accumulated torsional energy in the drill string 120 caused by the dampening effect of the top drive 116, the decrease 714 of the rotational speed set-point 836 of the top drive 116, the decrease 716 of the torque set-point 826 of the top drive 116, and/or the decrease 717 of the flow rate of the drilling fluid being pumped downhole by the mud pumps 144 may collectively decrease rotational speed spike 832 and the associated rotational acceleration of the drill bit 126 and the BHA 124.

After the drill string 120 becomes free from the formation 106, the processing device 300 may automatically resume 720 the drilling operations. For example, at time 836, the processing device 300 may automatically increase the rotational speed set-point 836 of the top drive 116 to a predetermined rotational speed, increase the torque set-point 826 of the top drive 116 to a predetermined torque, increase the flow rate of the drilling fluid being pumped downhole by the mud pumps 144, and cause the drawworks 118 to lower the drill string 120. The drill string 120 may be lowered until the drill bit 126 contacts the bottom of the wellbore 102 at time 838 to continue the drilling operations.

Instead of the processing device 300 automatically controlling the top drive 116 and the drawworks 118 to release the stored torsional energy from the drill string 120 in the controlled manner, rig personnel may manually control the top drive 116 and the drawworks 118 via the control workstation 197 to release the stored torsional energy from the drill string 120 in the controlled manner. For example, after the processing device 300 determines 708, 712 that the drill string 120 has become stuck, the processing device 300 may output 722 information indicating that the drill string 120 has become stuck to the video output device 196 for viewing by the rig personnel. The rig personnel may then decrease 724 the rotational speed set-point of the top drive 116 to zero RPM, decrease 726 the torque set-point of the top drive 116, and decrease 717 the flow rate of the drilling fluid being pumped downhole by the mud pumps 144, and then operate the drawworks 118 to lift 728 the drill string 120 to free the drill string 120 from the formation 106. The position measurements 814 in graph 804 show that the height of the traveling block 113 started to increase at time 828, thereby indicating that the drill string 120 was being lifted 728. Thus, after the stuck drill string 120 was detected, the hoisting system 212 (e.g., the drawworks 118) was operated at time 828 to lift the drill string 120 (and the drill bit 126) from the bottom of the wellbore 102 in an attempt to release the drill string 120 from the formation 106.

The rig personnel may then determine if the drill string 120 has been freed from the formation 106 based on various operational measurements described above and displayed on the video output device 196. For example, the rig personnel may determine if the drill string 120 has been freed from the formation 106 when the pressure measurements 813 indicate that the drilling fluid pressure output by the mud pumps 144 is decreasing further, when the drawworks 118 experiences a decrease in weight of the drill string 120, and/or when the torque measurements 811 indicate that the torque output by the top drive 116 is decreasing. After the drill string 120 becomes free from the formation 106, the rig personnel may resume 730 the drilling operations. For example, at time 836, the rig personnel may increase the rotational speed set-point 836 of the top drive 116 to a predetermined rotational speed, increase the torque set-point 826 of the top drive 116 to a predetermined torque, increase the flow rate of the drilling fluid being pumped downhole by the mud pumps 144, and cause the drawworks 118 to lower the drill string 120. The drill string 120 may be lowered until the drill bit 126 contacts the bottom of the wellbore 102 at time 838 to continue the drilling operations.

The method 750 may comprise commencing operation 752 of the processing device 300 (e.g., the surface equipment controller 192) of a well construction system 100 for drilling a well 102. Commencing operation of the processing device 300 may cause the processing device 300 to execute the computer program code 332, thereby causing the processing device 300 to perform at least a portion of the method 750.

Commencing operation 752 of the processing device 300 may cause the processing device 300 to receive 754 rotational speed measurements 812 indicative of rotational speed of a top drive 116 rotating a drill string 120 and receive 756 torque measurements 811 indicative of torque output by the top drive 116 to the drill string 120. The processing device 300 may then output 758 the torque measurements 811 and the rotational speed measurements 812 to the video output device 196 for viewing by rig personnel. For example, the processing device 300 may output 758 the torque measurements 811 and the rotational speed measurements 812 to the video output device 196 in the form of graphs 801, 802, respectively.

The rig personnel may then view 760 the rotational speed measurements 812 and the torque measurements 811 displayed on the video output device 196 and determine 762 that the drill string 120 has become stuck downhole based on the displayed rotational speed measurements 812 and torque measurements 811. For example, the rig personnel may determine 762 that the drill string 120 has become stuck downhole when the rotational speed measurements 812 indicate that the rotational speed of the top drive 116 is decreasing and the torque measurements 811 indicate that the torque output by the top drive 116 has increased to a predetermined maximum torque 822 that the top drive 116 can output. The rig personnel may determine 762 that the drill string 120 has become stuck downhole when the rotational speed measurements 812 indicate that the rotational speed of the top drive 116 has decreased to zero RPM at time 824 and the torque measurements 811 indicate that the torque output by the top drive 116 has increased to the predetermined maximum torque output level 822 of the top drive 116. Alternatively, the rig personnel may determine 762 that the drill string 120 has become stuck downhole when the rotational speed measurements 812 indicate that the rotational speed of the top drive 116 is decreasing, but before the rotational speed of the top drive 116 has decreased to zero RPM at time 824, and the torque measurements 811 indicate that the torque output by the top drive 116 has increased to the predetermined maximum torque output level 822 of the top drive 116. Still alternatively, the rig personnel may determine 762 that the drill string 120 has become stuck downhole when the rotational speed measurements 812 indicate that the rotational speed of the top drive 116 is decreasing and the torque measurements 811 indicate that the torque output by the top drive 116 has increased to the predetermined maximum torque output level 822 of the top drive 116 for a predetermined period of time 821 that starts at time 820 and ends at time 828.

The rig personnel may determine 764 that the drill string 120 has become stuck downhole based also on pressure measurements 813 of the mud pumps 144. For example, operating 752 the processing device 300 may further cause the processing device 300 to receive 766 the pressure measurements 813 indicative of the pressure of drilling fluid being pumped by the mud pumps 144 into the drill string 120. The processing device 300 may then output 768 the pressure measurements 813 to the video output device 196 for viewing by the rig personnel. For example, the processing device 300 may output 768 the pressure measurements 813 to the video output device 196 in the form of graph 803. The rig personnel may then view 770 the pressure measurements 813 displayed on the video output device 196 and determine 764 that the drill string 120 has become stuck downhole when, in addition to the changes in rotational speed measurements 812 and torque measurements 811 described above, the pressure measurements 813 also indicate that the pressure output by the mud pumps 144 is increasing.

When the rig personnel determines 762, 764 that the drill string 120 has become stuck downhole at time 828, the rig personnel may control the top drive 116 and the drawworks 118 to release the stored torsional energy from the drill string 120 in the controlled manner. For example, after the rig personnel determines 762, 764 that the drill string 120 has become stuck, the rig personnel may decrease 772 a rotational speed set-point 836 of the top drive 116 to zero RPM, decrease 774 a torque set-point 826 of the top drive 116 to a predetermined torque level, and decrease 775 flow rate of the drilling fluid being pumped downhole by the mud pumps 144, thereby preventing or inhibiting the drill string 120 to be twisted further by the top drive 116 and the mud motor 182, and thus preventing or inhibiting additional torsional energy to be stored in the drill string 120.

The predetermined torque level indicated by the torque set-point 826 may be or comprise the minimum torque level that the top drive 116 can output to the drill string 120. The predetermined torque level indicated by the torque set-point 826 may be or comprise a torque level of zero, which causes the top drive 116 not to output torque to the drill string 120. The flow rate of the drilling fluid may be decreased 775 to a level that facilitates sufficient electrical power to be generated downhole by a turbine to maintain downhole electrical devices (e.g., the sensors 184, the telemetry devices 186, and/or the controllers 188) of the BHA 124 electrically powered. For example, the flow rate of the drilling fluid may be decreased 775 to a flow rate that ranges between about 5% and about 25% above the "turn on" flow rate. Decreasing 772 the rotational speed set-point 836 of the top drive 116 to zero RPM and decreasing 774 the torque set-point 826 of the top drive 116 at time 828 may cause the top drive 116 to permit being rotated backward by the torsional energy accumulated in the drill string 120. Backward rotation of the top drive 120 may permit the drill string 120 to unwind in a controlled manner, thereby slowly dissipating the torsional energy accumulated in the drill string 120, as indicated by segment 823 of the torque measurements 811. The torsional energy accumulated in the drill string 120 may thus be released in a controlled manner by the top drive 116, which dissipates the accumulated torsional energy while being rotated backward by the torsional energy. If decreasing 772 the rotational speed set-point of the top drive 116 to zero RPM and decreasing 774 the torque set-point of the top drive 116 does not cause the top drive 116 to permit being rotated backward by the torsional energy accumulated in the drill string 120, the torsional energy may be released from the drill string 120 upon the drill string 120 being freed from the formation 106 at time 830, as indicated by segment 825 of the torque measurements 811. However, because the top drive 116 is no longer applying torque (or applying just a small amount of torque) to the drill string 120 and the mud motor 182 is applying a significantly lower torque to the drill string 120 when the drill string 120 becomes free at time 830, the rotational acceleration experienced by the BHA 124 may be significantly lower when the drill string 120 becomes free.

After the rig personnel decreases 772 the rotational speed set-point 836 of the top drive 116, decreases 774 the torque set-point 826 of the top drive 116, and decreases 775 the flow rate of the drilling fluid being pumped downhole by the mud pumps 144, the rig personnel may then cause the drawworks 118 to lift 776 the drill string 120 until the drill string 120 has been freed from the formation 106 at time 830. The rig personnel may determine that the drill string 120 has been freed from the formation 106 when, for example, the pressure measurements 813 indicate that the drilling fluid pressure output by the mud pumps 144 decreases further after (e.g., at time 830) the flow rate of the drilling fluid was decreased 775. The rig personnel may also or instead determine that the drill string 120 has been freed from the formation 106 when, for example, the drawworks 118 experiences a decrease in weight of the drill string 120. For a top drive 116 that does not permit reverse rotation, the rig personnel may determine that the drill string 120 has been freed from the formation 106 when, for example, the torque measurements 811 indicate that the torque output by the top drive 116 is decreasing, thereby indicating that the drill string 120 is free from the formation 106 and free to rotate.

Upon the drill string 120 becoming free from the formation 106 at time 830, the rotational speed measurements 815 indicate a slow increase in rotational speed, and thus lower acceleration of the BHA 124 and the drill bit 126 relative to the rotational speed measurements 415 shown in graph 405. The controlled release of the accumulated torsional energy in the drill string 120 caused by the dampening effect of the top drive 116, the decrease 772 of the rotational speed set-point 836 of the top drive 116, the decrease 774 of the torque set-point 826 of the top drive 116, and/or the decrease 775 of the flow rate of the drilling fluid being pumped downhole by the mud pumps 144 may collectively decrease rotational speed spike 832 and the associated rotational acceleration of the drill bit 126 and the BHA 124.

After the drill string 120 becomes free from the formation 106, the rig personnel may resume 778 the drilling operations. For example, at time 836, the rig personnel may increase the rotational speed set-point 836 of the top drive 116 to a predetermined rotational speed, increase the torque set-point 826 of the top drive 116 to a predetermined torque, increase the flow rate of the drilling fluid being pumped downhole by the mud pumps 144, and cause the drawworks 118 to lower the drill string 120. The drill string 120 may be lowered until the drill bit 126 contacts the bottom of the wellbore 102 at time 838 to continue the drilling operations.

Figure 23:
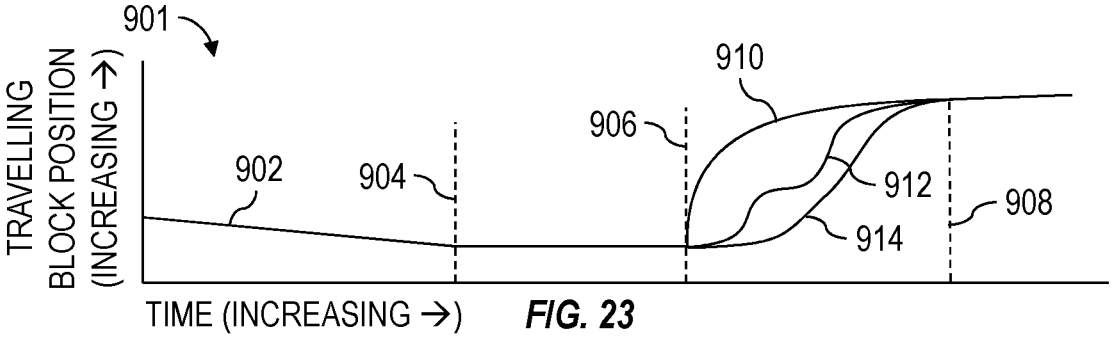

FIG. 23 is a graph 901 showing position (i.e., height) measurements 902 of the traveling block 113 of the well construction system 100 shown in FIG. 1 with respect to time before, during, and after a lower portion (e.g., the drill bit 124 and/or the BHA 124) of the drill string 120 becomes stuck downhole. The following description refers to FIGS. 1 and 23, collectively.

The position measurements 902 indicate that the height of the traveling block 113 stops decreasing at time 904, thereby indicating that the drill string 120 became stuck downhole and stopped descending into the formation 106 at time 904. The position measurements 902 further indicate that the height of the traveling block 113 started to increase at time 906 thereby indicating that the drill string 120 was being lifted upward to free the drill string 120 when or after it was determined that the drill string 120 became stuck. The position measurements 902 further indicate that the drill string 120 was lifted until and for at least a period of time after it was determined that the drill string 120 became free at time 908.

The drill string 120 may be lifted at a variable speed having a profile that facilitates a controlled (e.g., slow, gradual, progressive, etc.) release of the stored torsional energy from the drill string 120 when the drill string 120 becomes free at time 908. A first alternate variable speed profile 910 indicative of the speed at which the drill string 120 may be lifted includes quickly lifting the drill string 120 at time 906 and then decreasing the lifting speed as the drill string 120 approaches the point at which the drill string 120 becomes free at time 908. A second alternate variable speed profile 912 indicative of the speed at which the drill string 120 may be lifted includes alternately increasing and decreasing (i.e., speeding up and slowing down) the lifting speed of the drill string 120 between time 906 and time 908 at which the drill string 120 becomes free. Such variable speed profile 912 may include slowly lifting the drill string 120 at time 906 and then decreasing the lifting speed as the drill string 120 approaches the point at which the drill string 120 becomes free at time 908. A third alternate variable speed profile 914 indicative of the speed at which the drill string 120 may be lifted includes slowly lifting the drill string 120 at time 906, then increasing the lifting speed, and then decreasing the lifting speed as the drill string 120 approaches the point at which the drill string 120 becomes free at time 908.

Each of the variable speed profiles 910, 912, 914 may be implemented as part of the methods 500, 550, 700, 750 described above and shown in FIGS. 9, 10, 16, and 17, respectively. Each of the variable speed profiles 910, 912, 914 may be implemented as part of the lifting profiles indicated by position measurements 614, 814 shown in graphs 604, 804, respectively. Each of the variable speed profiles 910, 912, 914 may further improve or otherwise facilitate the controlled release of the accumulated torsional energy in the drill string 120, such that upon the drill string 120 becoming free from the formation 106 at time 908, the rotational speed measurements 615, 815 of the drill bit 126 may indicate a slower increase in rotational speed, and thus lower acceleration of the BHA 124 and the drill bit 126, relative to the rotational speed measurements 415 shown in graph 405.

In view of the entirety of the present disclosure, including the figures and the claims, a person having ordinary skill in the art will readily recognize that the present disclosure introduces an apparatus comprising: a rotation sensor operable to facilitate rotational speed measurements indicative of rotational speed of a top drive for rotating a drill string; a torque sensor operable to facilitate torque measurements indicative of torque output by the top drive; and a processing device comprising a processor and a memory storing computer program code. The processing device is operable to: (A) monitor the rotational speed measurements and the torque measurements during drilling operations; and (B) determine that a lower portion of the drill string has become stuck downhole when: (i) the rotational speed measurements indicate that the rotational speed of the top drive is decreasing; and (ii) the torque measurements indicate that the torque output by the top drive has increased to a predetermined maximum torque level.

The processing device may be operable to determine that the lower portion of the drill string has become stuck downhole when the rotational speed measurements indicate that the rotational speed of the top drive has decreased to zero.

The processing device may be operable to determine that the lower portion of the drill string has become stuck downhole when the torque measurements indicate that the torque output by the top drive has increased to the predetermined maximum torque level for at least a predetermined period of time.

The apparatus may comprise a pressure sensor operable to facilitate pressure measurements indicative of pressure of drilling mud being pumped through the drill string by mud pumps. The processing device may be operable to: monitor the pressure measurements during the drilling operations; and determine that the lower portion of the drill string has become stuck downhole also when the pressure measurements indicate that the pressure of the drilling mud being pumped by the mud pumps is increasing.

After determining that the lower portion of the drill string has become stuck downhole, the processing device may be operable to: decrease a rotational speed set-point of the top drive and decrease a torque set-point of the top drive; and then cause a drawworks to lift the drill string to free the drill string.

After determining that the lower portion of the drill string has become stuck downhole, the processing device may be operable to output information indicative that the lower portion of the drill string has become stuck downhole to a video output device for viewing by rig personnel such that the rig personnel can: decrease a rotational speed set-point of the top drive and decrease a torque set-point of the top drive; and then operate a drawworks to lift the drill string to free the drill string.

Determining that the lower portion of the drill string has become stuck downhole may comprise determining that at least one of a drill bit and a bottom-hole assembly has become stuck downhole.

The present disclosure also introduces a method comprising controlling release of torsional energy from a drill string having a lower portion that is stuck against a subterranean formation and a top end rotated by a top drive by: decreasing a rotational speed set-point of the top drive and decreasing a torque set-point of the top drive; and then lifting the drill string to free the drill string.

Decreasing the rotational speed set-point of the top drive may comprise decreasing the rotational speed set-point of the top drive to zero.

Decreasing the torque set-point of the top drive may comprise decreasing the torque set-point of the top drive to a minimum torque level that the top drive can output.

Decreasing the rotational speed set-point of the top drive and decreasing the torque set-point of the top drive may cause the top drive to permit being rotated by the torsional energy in the drill string, thereby dissipating the torsional energy in the drill string.

The method may comprise, while lifting the drill string: monitoring torque measurements indicative of torque output by the top drive; and determining that the drill string has been freed from the formation when the torque measurements indicate that the torque output by the top drive is decreasing.

Controlling the release of torsional energy from the drill string may further comprise, before lifting the drill string, decreasing flow rate of drilling mud being pumped downhole via the drill string, thereby decreasing torque output by a mud motor rotating a drill bit. In such implementations, among others within the scope of the present disclosure, the method may further comprise, while lifting the drill string: monitoring pressure measurements indicative of pressure of the drilling mud being pumped downhole via the drill string; and determining that the drill string has been freed from the formation when the pressure measurements indicate that the pressure of the drilling mud is decreasing.

The present disclosure also introduces a method comprising: (A) monitoring rotational speed measurements indicative of rotational speed of a top drive rotating a drill string; (B) monitoring torque measurements indicative of torque output by the top drive to the drill string; and (C) determining that a lower portion of the drill string has become stuck downhole when: (i) the rotational speed measurements indicate that the rotational speed of the top drive is decreasing; and (ii) the torque measurements indicate that the torque output by the top drive has increased to a predetermined maximum torque level.

The lower portion of the drill string may be determined to have become stuck downhole when the rotational speed measurements indicate that the rotational speed of the top drive has decreased to zero.

The lower portion of the drill string may be determined to have become stuck downhole when the torque measurements indicate that the torque output by the top drive has increased to the predetermined maximum torque level for at least a predetermined period of time.

The method may further comprise: monitoring pressure measurements indicative of pressure of drilling mud being pumped downhole through the drill string by mud pumps; and determining that the lower portion of the drill string has become stuck downhole when, also, the pressure measurements indicate that the pressure of the drilling mud being pumped is increasing.

The method may comprise, after determining that the lower portion of the drill string has become stuck downhole, controlling release of torsional energy stored in the drill string by: decreasing a rotational speed set-point of the top drive to zero and decreasing a torque set-point of the top drive; and then lifting the drill string to free the drill string. In such implementations, among others within the scope of the present disclosure, controlling the release of torsional energy stored in the drill string may further comprise, before lifting the drill string, decreasing flow rate of drilling mud being pumped downhole via the drill string, thereby decreasing torque output by a mud motor rotating a drill bit.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same functions and/or achieving the same benefits of the embodiments introduced herein. A person having ordinary skill in the art should also realize that such equivalent constructions do not depart from the scope of the present disclosure, and that they may make various changes, substitutions and alterations herein without departing from the spirit and scope of the present disclosure.

The Abstract at the end of this disclosure is provided to comply with 37 C.F.R. § 1.72(b) to allow the reader to quickly ascertain the nature of the technical disclosure. It is submitted with the understanding that it will not be used to interpret or limit the scope or meaning of the claims.

What is claimed is:

1. A system comprising:

a rotation sensor operable to facilitate rotational speed measurements indicative of rotational speed of a top drive for rotating a drill string;

a torque sensor operable to facilitate torque measurements indicative of torque output by the top drive; and a processing device comprising a processor and a memory storing computer program code, wherein the processing device is operable to:

monitor the rotational speed measurements and the torque measurements during drilling operations;

determine that a lower portion of the drill string has become stuck downhole when:

the rotational speed measurements indicate that the rotational speed of the top drive is decreasing; and the torque measurements indicate that the torque output by the top drive has increased to a predetermined maximum torque level; and decrease a torque set-point of the top drive in response to determining that the lower portion of the drill string has become stuck downhole.

2. The system of claim 1 wherein the processing device is operable to determine that the lower portion of the drill string has become stuck downhole when the rotational speed measurements indicate that the rotational speed of the top drive has decreased to zero.

3. The system of claim 1 wherein the processing device is operable to determine that the lower portion of the drill string has become stuck downhole when the torque measurements indicate that the torque output by the top drive has increased to the predetermined maximum torque level for at least a predetermined period of time.

4. The system of claim 1 further comprising a pressure sensor operable to facilitate pressure measurements indicative of pressure of drilling mud being pumped through the drill string by mud pumps, wherein the processing device is further operable to:

monitor the pressure measurements during the drilling operations; and determine that the lower portion of the drill string has become stuck downhole when, also, the pressure measurements indicate that the pressure of the drilling mud being pumped by the mud pumps is increasing.

5. The system of claim 1 wherein, after determining that the lower portion of the drill string has become stuck downhole, the processing device is further operable to:

decrease a rotational speed set-point of the top drive and decrease the torque set-point of the top drive; and then cause a drawworks to lift the drill string to free the drill string.

6. The system of claim 1 wherein, after determining that the lower portion of the drill string has become stuck downhole, the processing device is further operable to output information indicative that the lower portion of the drill string has become stuck downhole to a video output device for viewing by rig personnel.

7. The system of claim 1 wherein determining that the lower portion of the drill string has become stuck downhole comprises determining that at least one of a drill bit and a bottom-hole assembly has become stuck downhole.

8. A method comprising:

controlling release of torsional energy from a drill string having a lower portion that is stuck against a subterranean formation and a top end rotated by a top drive by:

decreasing a rotational speed set-point of the top drive and decreasing a torque set-point of the top drive; and then lifting the drill string to free the drill string.

9. The method of claim 8 wherein decreasing the rotational speed set-point of the top drive comprises decreasing the rotational speed set-point of the top drive to zero.

10. The method of claim 8 wherein decreasing the torque set-point of the top drive comprises decreasing the torque set-point of the top drive to a minimum torque level that the top drive can output.

11. The method of claim 8 wherein decreasing the rotational speed set-point of the top drive and decreasing the torque set-point of the top drive causes the top drive to permit being rotated by the torsional energy in the drill string, thereby dissipating the torsional energy in the drill string.

12. The method of claim 8 further comprising, while lifting the drill string:

monitoring torque measurements indicative of torque output by the top drive; and determining that the drill string has been freed from the formation when the torque measurements indicate that the torque output by the top drive is decreasing.

13. The method of claim 8 wherein controlling the release of torsional energy from the drill string further comprises, before lifting the drill string, decreasing flow rate of drilling mud being pumped downhole via the drill string, thereby decreasing torque output by a mud motor rotating a drill bit.

14. The method of claim 13 further comprising, while lifting the drill string:

monitoring pressure measurements indicative of pressure of the drilling mud being pumped downhole via the drill string; and determining that the drill string has been freed from the formation when the pressure measurements indicate that the pressure of the drilling mud is decreasing.

15. A method comprising:

monitoring rotational speed measurements indicative of rotational speed of a top drive rotating a drill string;

monitoring torque measurements indicative of torque output by the top drive to the drill string; and determining that a lower portion of the drill string has become stuck downhole in response to:

the rotational speed measurements indicating that the rotational speed of the top drive is decreasing; and the torque measurements indicating that the torque output by the top drive has increased to a predetermined maximum torque level; and decreasing a torque set-point of the top drive in response to determining that the lower portion of the drill string has become stuck downhole.

16. The method of claim 15 comprising determining that the lower portion of the drill string is stuck downhole in response to the rotational speed measurements indicating that the rotational speed of the top drive has decreased to zero.

17. The method of claim 15 comprising determining that the lower portion of the drill string is stuck downhole in response to the torque measurements indicating that the torque output by the top drive has increased to the predetermined maximum torque level for at least a predetermined period of time.

18. The method of claim 15 further comprising:

monitoring pressure measurements indicative of pressure of drilling mud being pumped downhole through the drill string by mud pumps; and determining that the lower portion of the drill string has become stuck downhole in response to, also, the pressure measurements indicating that the pressure of the drilling mud being pumped is increasing.

19. The method of claim 15 further comprising, after determining that the lower portion of the drill string has become stuck downhole, controlling release of torsional energy stored in the drill string by:

decreasing a rotational speed set-point of the top drive to zero and decreasing the torque set-point of the top drive; and then lifting the drill string to free the drill string.

20. The method of claim 19 wherein controlling the release of torsional energy stored in the drill string further comprises, before lifting the drill string, decreasing flow rate of drilling mud being pumped downhole via the drill string, thereby decreasing torque output by a mud motor rotating a drill bit.

* * * * *